US006142600A

United States Patent [19]

Takahashi et al.

[11] Patent Number: 6,142,600

[45] Date of Patent: Nov. 7, 2000

[54] PRINT CONTROL METHOD AND PRINTER

[75] Inventors: Kiichiro Takahashi, Kawasaki; Naoji Ohtsuka; Kentaro Yano, both of Yokohama; Hitoshi Nishikori, Inagi; Osamu Iwasaki, Tokyo; Daigoro Kanematsu, Yokohama; Hidehiko Kanda, Kawasaki, all of Japan

[73] Assignee: Canon Kabushiki Kaisha, Tokyo, Japan

[21] Appl. No.: 08/844,854

[22] Filed: Apr. 22, 1997

[30] Foreign Application Priority Data

Apr. 23, 1996 [JP] Japan ..... 8-101715
Mar. 28, 1997 [JP] Japan ..... 9-078426

[51] Int. Cl.[7] ..... B41J 2/165

[52] U.S. Cl. ..... 347/23; 347/12; 347/30

[58] Field of Search ..... 347/7, 12, 13, 347/35, 23, 30

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,516,135 | 5/1985 | Todoh | 347/184 |
| 4,528,576 | 7/1985 | Koumura et al. | 347/15 |
| 4,558,333 | 12/1985 | Sugitani et al. | 346/140 R |
| 4,560,997 | 12/1985 | Sato et al. | 347/15 |
| 4,608,577 | 8/1986 | Hori | 346/140 R |
| 4,617,580 | 10/1986 | Miyakawa | 346/136 |
| 4,635,078 | 1/1987 | Sakurada et al. | 346/140 R |
| 4,723,129 | 2/1988 | Endo et al. | 346/1.1 |
| 4,740,796 | 4/1988 | Endo et al. | 346/1.1 |
| 4,860,026 | 8/1989 | Matsumoto et al. | 347/15 |
| 5,049,898 | 9/1991 | Arthur et al. | 347/19 |
| 5,097,343 | 3/1992 | Chiba et al. | 358/296 |
| 5,138,344 | 8/1992 | Ujita | 347/86 |
| 5,235,351 | 8/1993 | Koizumi | 346/140 R |
| 5,245,362 | 9/1993 | Iwata et al. | 346/140 R |
| 5,394,250 | 2/1995 | Shono | 358/455 |
| 5,448,274 | 9/1995 | Hirabayashi et al. | 347/86 |
| 5,579,446 | 11/1996 | Naik et al. | 395/109 |
| 5,604,520 | 2/1997 | Masubara et al. | 347/43 |
| 5,625,384 | 4/1997 | Numata et al. | 347/23 |
| 5,625,397 | 4/1997 | Allred et al. | 347/100 |
| 5,729,259 | 3/1998 | Gotoh et al. | 347/43 |
| 5,742,306 | 4/1998 | Gompertz et al. | 347/43 |
| 5,805,180 | 9/1998 | Ebisawa et al. | 347/23 |
| 5,818,474 | 10/1998 | Takahashi et al. | 347/15 |
| 5,828,389 | 10/1998 | Yamaguchi et al. | 347/23 |
| 5,831,646 | 11/1998 | Kuronuma et al. | 347/30 |

FOREIGN PATENT DOCUMENTS

| | | |
|---|---|---|
| 0 351 754 | 1/1990 | European Pat. Off. . |
| 0 372 826 A2 | 6/1990 | European Pat. Off. . |
| 0 401 023 | 12/1990 | European Pat. Off. . |
| 0 440 261 A2 | 8/1991 | European Pat. Off. . |
| 0 585 028 A1 | 3/1994 | European Pat. Off. . |

(List continued on next page.)

*Primary Examiner*—N. Le
*Assistant Examiner*—Shih-wen Hsieh
*Attorney, Agent, or Firm*—Fitzpatrick, Cella, Harper & Scinto

[57] ABSTRACT

Disclosed are an inkjet printing method and an inkjet printer capable of printing high-quality images by the inkjet printing method even when ink is exchanged for ink having a different density, particularly ink having a lower density. A printer using this method identifies the type of an ink tank attached to a printhead. When the printer detects in accordance with the type of an ink tank that an ink tank is changed to another ink tank containing ink with a different density, recovery conditions for the printhead are changed in accordance with the type of the ink. Especially when an ink tank is exchanged for another ink tank containing ink with a lower density, the printer increases the number of times of suction for the printhead after the ink tank exchange and the number of times of preliminary discharge after wiping. The printer also shortens preliminary discharge intervals and increases the number of preliminary discharge times at the time of printing.

58 Claims, 24 Drawing Sheets

FOREIGN PATENT DOCUMENTS

| | | |
|---|---|---|
| 0 595 517 A1 | 5/1994 | European Pat. Off. . |
| 0 600 735 | 6/1994 | European Pat. Off. . |
| 0 627 323 | 12/1994 | European Pat. Off. . |
| 0 628 415 A2 | 12/1994 | European Pat. Off. . |
| 0 630 752 A2 | 12/1994 | European Pat. Off. . |
| 0 642 260 | 3/1995 | European Pat. Off. . |
| 0 654 352 A3 | 5/1995 | European Pat. Off. . |
| 0 687 565 | 12/1995 | European Pat. Off. . |
| 0 688 673 A2 | 12/1995 | European Pat. Off. . |
| 0 700 786 | 3/1996 | European Pat. Off. . |
| 0 720 916 | 7/1996 | European Pat. Off. . |
| 0 741 488 | 11/1996 | European Pat. Off. . |
| 0 750 994 | 1/1997 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 60-163571 | 8/1985 | Japan . |
| 2-031562 | 2/1990 | Japan . |
| 3-005156 | 1/1991 | Japan . |
| 3-051138 | 3/1991 | Japan . |
| 6-155758 | 6/1994 | Japan . |
| 6-199031 | 7/1994 | Japan . |
| 7052390 | 2/1995 | Japan . |
| 7144419 | 6/1995 | Japan . |

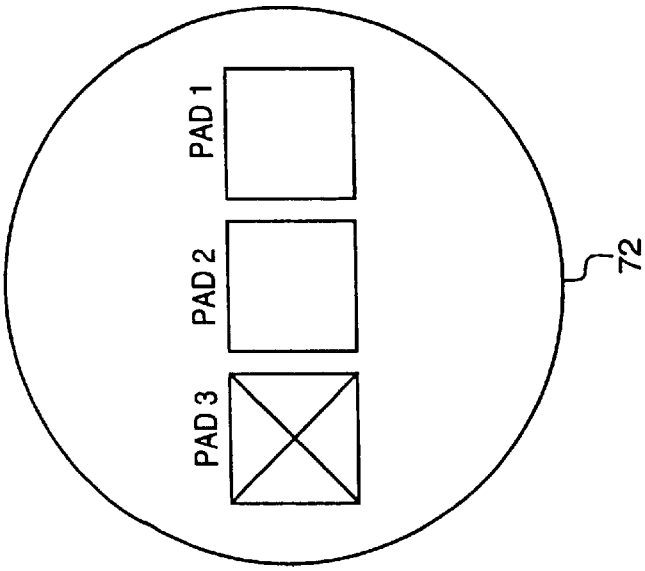
FIG. 7B
FIG. 7A
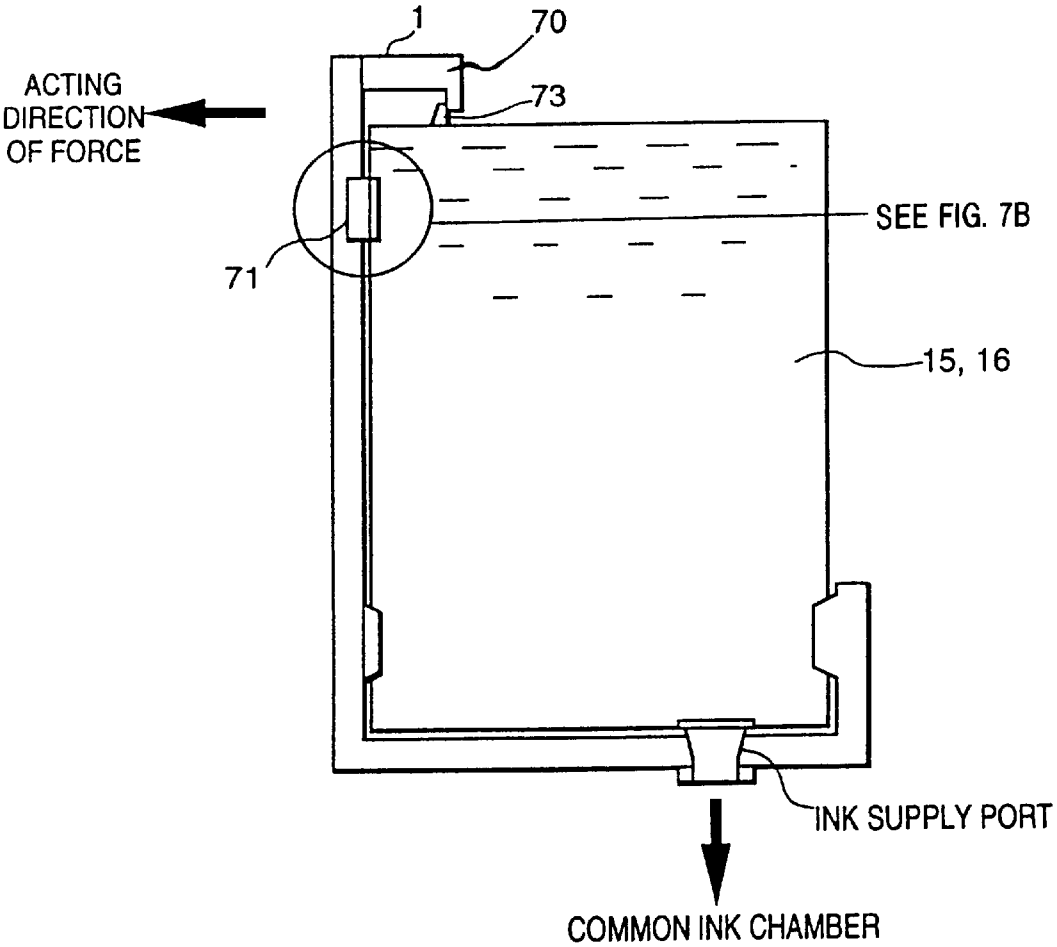

FIG. 9

RECOVERY CONDITIONS IN TANK EXCHANGE

| | INK TANK 1 | INK TANK 2 | INK TANK 3 |
|---|---|---|---|
| NUMBER OF SUCTION RECOVERY TIMES IN TANK EXCHANGE | 1 | 2 | 3 |
| NUMBER OF SUCTION RECOVERY TIMES IN NORMAL USE OF PRINTER | 1 | 1 | 1 |
| NUMBER OF PRELIMINARY DISCHARGE TIMES AFTER WIPING | 50 | 100 | 150 |
| PRELIMINARY DISCHARGE INTERVAL DURING PRINTING | 12sec | 8sec | 6sec |
| NUMBER OF PRELIMINARY DISCHARGE TIMES DURING PRINTING | 15 | 11 | 8 |

FIG. 14

| BLOCK NUMBER | TIMER VALUE |
|---|---|
| 1 | |
| 2 | |
| ⋮ | ⋮ |
| 7 | |
| 8 | |

FIG. 18

RECOVERY CONDITIONS IN EXCHANGE OF INTEGRATED INK CARTRIDGES

| | INK CARTRIDGE 1 | INK CARTRIDGE 2 | INK CARTRIDGE 3 |
|---|---|---|---|
| NUMBER OF SUCTION RECOVERY TIMES IN INK CARTRIDGE EXCHANGE | 1 AIR-SUCTION / 1 SUCTION | 2 AIR-SUCTIONS / 1 SUCTION | 3 AIR-SUCTIONS / 1 SUCTION |
| NUMBER OF SUCTION RECOVERY TIMES IN NORMAL USE OF PRINTER | 1 AIR-SUCTION / 1 SUCTION | 1 AIR-SUCTION / 1 SUCTION | 1 AIR-SUCTION / 1 SUCTION |
| NUMBER OF PRELIMINARY DISCHARGE TIMES AFTER WIPING | 50 | 100 | 150 |
| PRELIMINARY DISCHARGE INTERVAL DURING PRINTING | 12sec | 8sec | 6sec |
| NUMBER OF PRELIMINARY DISCHARGE TIMES DURING PRINTING | 15 | 11 | 8 |

FIG. 23

PRINT MODE

- ○ NORMAL MODE
- ○ PICTORIAL MODE 1
- ○ PICTORIAL MODE 2
- ○ BLACK-AND-WHITE MODE

FIG. 24

SET ANY OF PLAIN PAPER, COATED PAPER, AND PICTORIAL PAPER

FIG. 25

ATTACH INK CARTRIDGE FOR PICTORIAL MODE 1

CURRENT INK CARTRIDGE

NORMAL MODE

PRINT CONTROL METHOD AND PRINTER

CROSS-REFERENCE TO RELATED APPLICATIONS

This application is related to U.S. patent application Ser. No. 08/844,740, Ser. No. 08/847,743, Ser. No. 08/847,744 and Ser. No. 08/847,984, all filed on Apr. 22, 1997. All the applications are assigned to the assignee of this application and are incorporated herein by reference.

BACKGROUND OF THE INVENTION

This invention relates to a print control method and a printer and, more particularly, to a print control method and a printer according to an inkjet printing method which prints images on a printing medium by using a printhead for performing print by using inks.

As inkjet printers, monochrome inkjet printers for performing monochrome printing by using an ink of one color and color inkjet printers for performing color printing by using inks of a plurality of colors are commercially available. Color inkjet printers generally print color images by using inks of three colors, i.e., yellow (Y), magenta (M), and cyan (C). Some color inkjet printers also use black (K) in addition to these three colors.

Recently, with the spread of personal computers, information processors, and communication apparatuses, printers which perform digital image printing by using an inkjet printhead have rapidly found widespread use as one image forming (printing) device of these apparatuses. Also, as the image quality and the ability to process color images of these information and communication apparatuses have been improved, demands on the image quality and the ability to process color images of printers as output devices of these apparatuses are increasing. To increase the printing speed, printers of this sort use a printhead in which orifices and ink channels are integrated at a high density, as a printhead (to be referred to as a multihead hereinafter) having an integrated array of a plurality of print elements. A color printhead generally has dedicated head units for inks of cyan, magenta, yellow, and black. However, the density of integration of ink orifices and ink channels cannot be unlimitedly increased. As a consequence, an ink dot shape (graininess) becomes conspicuous in a highlight portion of an image. This is a problem in high-quality printing of images.

As an approach to realize high-quality image printing by improving the construction of an apparatus, a so-called multi-drop printing method has been proposed. In this method, instead of increasing the integration density of orifices and ink channels, the dot diameter of a discharged ink is decreased, and these small dots are printed a plurality of times in one pixel in accordance with the print density. In this multi-drop method, the image quality of a highlight portion is slightly improved because the dot diameter is smaller than usual. However, the size of ink droplets to be discharged cannot be unlimitedly decreased due to the relationship with the stability of discharge. This limits an improvement of the image quality.

As another approach by which the image quality is improved without increasing the integration density of orifices and ink channels, a printing method has been proposed in which thin inks of the same color with different dye concentrations are used such that a highlight portion of an image is printed with a thin ink to make the ink dot shape inconspicuous. Printers of this sort can perform printing by using either regular thick inks or thin inks by exchanging ink tanks (or cartridges) storing the thick inks for ink tanks (or cartridges) storing the thin inks.

Unfortunately, when printing is performed by exchanging ink tanks storing inks of the same color with a plurality of different densities in an inkjet printer capable of printing by exchanging these ink tanks, or when printing is performed by exchanging ink cartridges using inks of the same color with a plurality of different densities, printing is not always performed under the same conditions, and this results in the following problems.

(1) Ink Mixing

When ink tanks are exchanged, if an ink used after the exchange has a density different from that of an ink used before the exchange, the ink before the exchange remaining inside a printhead (e.g., a common ink compartment or an ink supply passage) sometimes has an influence on the ink density after the exchange. For example, when an ink tank containing a thick ink is exchanged for an ink tank containing a thin ink, the thick ink remaining inside a printhead mixes in the thin ink to increase the density to be higher than a normal thin ink density. If printing is performed in this state, the density is initially high and gradually decreases as the printing progresses. Finally, the normal density of the thin ink is obtained. This is not a problem at all when inks having the same density are used. That is, this is an intrinsic phenomenon when inks having different densities are used by exchanging ink tanks.

Also, when ink cartridges are exchanged, an ink used before the exchange adheres to a wiping member or a capping member and sometimes has an influence on the ink density after the exchange. For example, an ink cartridge of a thick ink is exchanged for an ink cartridge of a thin ink, the thick ink adhering to the above member mixes with the thin ink. This has an influence on an image printed after a recovery operation such as wiping or capping. This is also an intrinsic phenomenon when printing is performed by the same printer by using inks having different densities.

(2) Density Variation

The optical reflection density of a thin ink changes largely with a change in dye concentration when compared to a regular thick ink. FIG. 2 shows a change of the reflection density as a function of a change in dye concentration. Referring to FIG. 2, the reflection density is normalized by assuming that the dye concentration of the regular thick ink is 1.0 and the corresponding reflection density is 1.0. When the dye concentration of a thick ink changes between 0.8 and 1.0, the reflection density changes between 0.93 and 1.0; i.e., the change width of the reflection density is 0.07. In contrast, when a thin ink prepared by diluting the regular thick ink having a dye concentration of 1.0 five times is used, a change in reflection density with a change in dye concentration from 0.1 to 0.3 centered on a dye concentration of 0.2 is 0.30 (=0.59−0.29). The reflection density of a thin ink is more sensitive, than that of a thick ink, to the same change width of the dye concentration; i.e., the reflection density of the thin ink changes larger than that of the thick ink. Accordingly, when the dye concentration of an ink in an ink discharge nozzle not used in printing in a printhead changes because, e.g., the nozzle is dried, the reflection density of the thin ink varies larger than that of the thick ink.

The foregoing is a problem when ink tanks or ink cartridges containing inks of the same color with different densities are interchangeably used. This problem is unavoidable when high-quality color images are formed by using inks of the same color with a plurality of different densities.

SUMMARY OF THE INVENTION

Accordingly, it is an object of the present invention to provide a print control method and a printer capable of printing high-quality images even if, for example, an ink is exchanged for an ink having a different density when printing is performed by an inkjet printing method.

It is another object of the present invention to provide a print control method and a printer capable of obtaining high-quality images, even if an ink used in printing is switched from a high-density ink to a low-density ink, by minimizing a variation of the ink density being due to mixing of the remaining ink.

It is still another object of the present invention to provide a print control method and a printer in which when an ink with a low density is used, a density variation being due to the remaining ink is decreased by increasing the number of times of suction of a printhead after the ink exchange, thereby suppressing the influence on images.

It is still another object of the present invention to provide a print control method and a printer in which when an ink with a low density is used, a density variation of the ink is decreased by increasing the number of times of preliminary discharge, thereby suppressing the influence on images.

It is still another object of the present invention to provide a print control method and a printer in which when an ink with a low density is used, a density variation of the ink is decreased by shortening preliminary discharge intervals, thereby suppressing the influence on images.

It is still another object of the present invention to provide a print control method and a printer in which when an ink with a low density is used, a density variation of the ink is decreased by increasing the number of times of preliminary discharge after the front surface of a printhead is cleaned, thereby suppressing the influence on images.

It is still another object of the present invention to provide a print control method and a printer in which when an ink tank is exchanged for an ink tank storing an ink with a low density, the residual ink is removed by drawing a printhead by suction with no ink tank being attached, thereby decreasing a density variation of the ink to be used in printing.

It is still another object of the present invention to provide a printer which achieves the approach as described above by cooperating with a host computer and can print high-quality images by decreasing a density variation of an ink to be used in printing.

According to the present invention, the foregoing object is attained by providing an inkjet printer in which a printhead for discharging ink and an ink tank for storing the ink can be separated, and which performs printing by using an ink cartridge including the printhead and the ink tank, comprising: detecting means for detecting or not whether the ink tank is attached; identifying means for identifying a type of the attached ink tank detected by the detecting means; setting means for setting recovery conditions of a recovery operation for the printhead to be executed immediately after the ink tank is attached, in accordance with the type identified by the identifying means; and recovery means for executing the recovery operation in accordance with the recovery conditions set by the setting means.

According to the present invention, the foregoing object is attained by providing an inkjet printer for performing printing by using a printhead for discharging ink, comprising: dividing means for dividing a plurality of print elements of the printhead into a plurality of blocks; measuring means for measuring a time elapsed from the latest ink discharge for each of the blocks divided by the dividing means; comparing means for comparing the elapsed time of each block measured by the measuring means with a predetermined time; and preliminary discharge control means for controlling each block to perform preliminary ink discharge in accordance with the comparison result by the comparing means.

According to the present invention, the foregoing object is attained by providing an inkjet printer for performing printing by using an ink cartridge in which a printhead for discharging ink and an ink tank for storing the ink are integrally formed, comprising: capping means for capping an ink discharge surface of the printhead; detecting means for detecting whether or not the ink cartridge is attached; identifying means for identifying a type of the attached ink cartridge detected by the detecting means; setting means for setting recovery conditions of a recovery operation, which includes a first suction operation, to be executed immediately after the ink cartridge is attached, for drawing an interior of the capping means by suction and a second suction operation for drawing ink discharge nozzles of the printhead by suction, in accordance with the type identified by the identifying means; and recovery means for executing the recovery operation in accordance with the recovery conditions set by the setting means.

The invention is particularly advantageous since high-quality images can be printed while ink consumption necessary for suction recovery is minimized even when an ink is exchanged for an ink with a different density.

Also, even when an ink used in printing is switched from a high-density ink to a low-density ink, high-quality images can be obtained by decreasing an ink density variation resulting from mixing of the residual ink.

When an ink with a low density is used, the number of times of suction of a printhead after ink exchange is increased. Since this decreases a density variation resulting from mixing of the residual ink, the influence on images can be suppressed.

When an ink with a low density is used, preliminary discharge is performed for each block of a printhead in accordance with the time elapsed from an ink discharge operation measured for each block. This suppresses the influence of an ink density variation on images.

When an ink with a low density is used, preliminary discharge intervals are shortened. This suppresses the influence of an ink density variation on images.

When an ink with a low density is used, the number of times of preliminary discharge after the front surface of a printhead is cleaned is increased. This suppresses the influence of an ink density variation on images.

When an ink tank is exchanged for an ink tank storing an ink with a low density, the residual ink is removed by drawing a printhead by suction while no ink tank is attached. This decreases a density variation of an ink used in printing.

An operation of decreasing a density variation of an ink used in printing in accordance with the approach as described above can be performed by an instruction from a host computer.

Furthermore, when an ink cartridge in which a printhead and an ink tank are integrally formed is used, the recovery conditions of a recovery operation including a first suction operation, to be executed immediately after the ink cartridge is attached, for drawing the interior portion of a capping means by suction and a second suction operation for drawing ink discharge nozzles of the printhead by suction are set in accordance with the type of the ink cartridge, and the recovery operation is executed in accordance with the set recovery conditions. Consequently, the residual ink previously used can be reliably removed from the inside of the capping means. This decreases a density variation of an ink being due to mixing of the residual ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 7A and 7B are views for explaining electrical connection when the detachable ink tank is attached;

FIG. 9 is a view for explaining set values of recovery conditions when ink tanks are exchanged according to the first embodiment of the present invention;

FIG. 14 is a view showing the relationship between the nozzle block and the timer value according to the second embodiment of the present invention;

FIG. 18 is a view for explaining set values of recovery conditions when ink cartridges are exchanged according to the fourth embodiment of the present invention;

FIGS. 23, 24, and 25 are views showing display examples on a monitor screen when a print mode is manually set in the fifth embodiment.

DESCRIPTION OF THE PREFERRED EMBODIMENTS

Preferred embodiments of the present invention will now be described in detail in accordance with the accompanying drawings.

Figure 1:
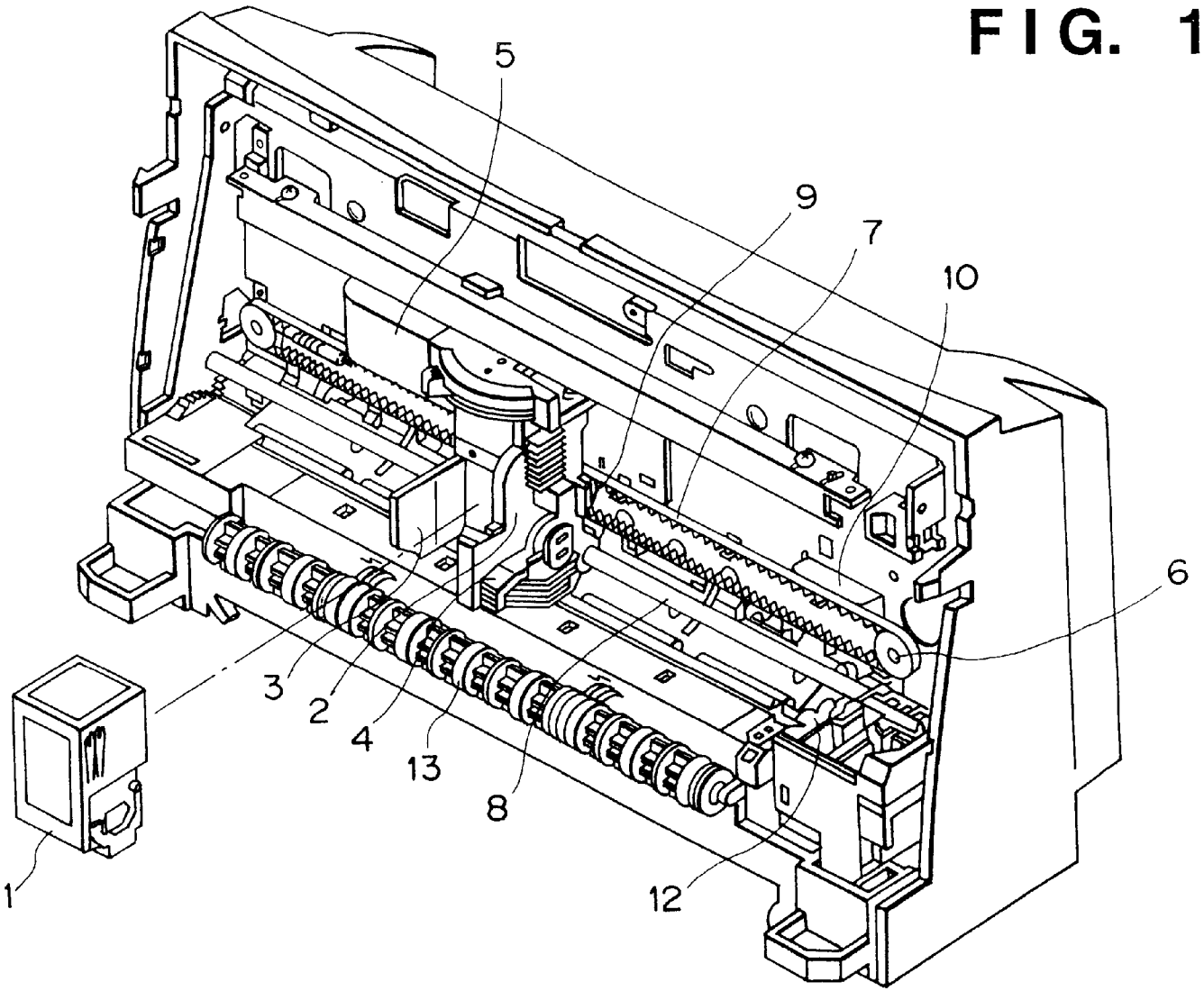
FIG. 1 is a perspective view showing the printing mechanism of an inkjet printer as a common embodiment of the present invention.

FIG. 1 shows the mechanical structure of an inkjet printer used in common in several embodiments to be described later and using an exchangeable ink cartridge. FIG. 1 shows the state in which the front cover of this inkjet printer is removed to expose the printer structure. This ink cartridge includes a printhead and an exchangeable ink tank.

In FIG. 1, reference numeral 1 denotes an exchangeable ink tank; 2, a carriage unit for mounting the ink cartridge 1; and 3, a holder for fixing the ink cartridge 1 to the carriage unit 2. The holder 3 is interlocked with a cartridge fixing lever 4. That is, after the ink cartridge 1 is loaded in the carriage unit 2, the cartridge fixing lever 4 is rotated so that the ink cartridge 1 can be tightly attached in the carriage unit 2. Consequently, it is possible to correctly position the ink cartridge 1 and attain electrical contact between the ink cartridge 1 and the carriage unit 2. A flexible cable 5 transmits an electrical signal to the carriage unit 2. A carriage motor 6 moves the carriage unit 2 back and forth in a main scan direction. A carriage belt 7 is driven by the carriage motor 6 to move the carriage unit 2. A guide shaft 8 supports the carriage unit 2. A home position sensor 9 includes, e.g., a photocoupler for determining the home position of the carriage unit 2. Reference numeral 10 denotes a light-shielding plate. When the carriage unit 2 reaches the home position, the light-shielding plate 10 interrupts light to the photocoupler of the home position sensor 9. Consequently, the arrival of the carriage unit 2 to the home position is detected. Reference numeral 12 denotes a home position unit including a recovery mechanism for a printhead. This recovery mechanism includes a capping unit for preventing drying of ink orifices of the printhead, a pump unit for performing suction recovery for removing contamination from the ink orifices and the interior of the printhead, a wiping unit for removing contamination from the ink orifices, and a unit for disposing of waste ink due to preliminary discharge during printing. Reference numeral 13 denotes a paper discharging roller for discharging a printing medium. The paper discharging roller 13 pinches a printing medium together with a spur unit (not shown) and discharges the medium outside the printer.

Figure 3A:
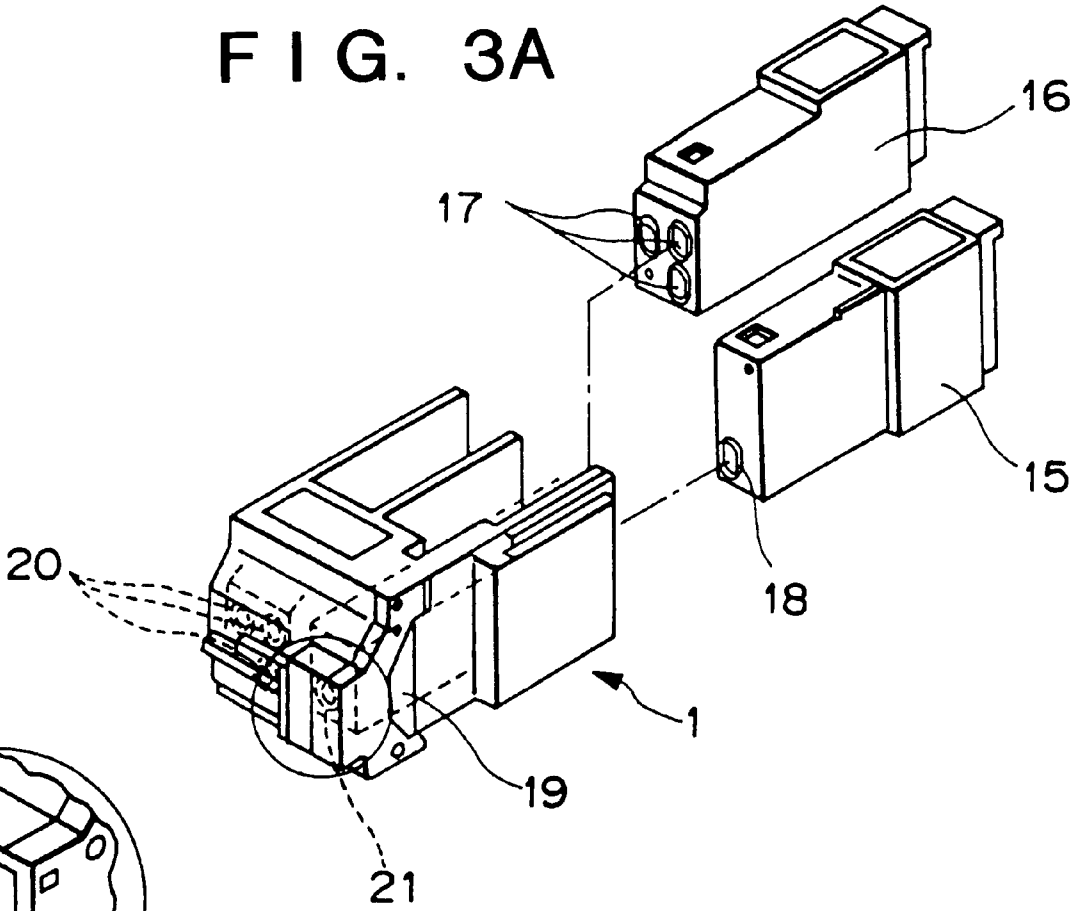
FIG. 3A is a perspective view showing the construction of an ink cartridge including a printhead and a detachable ink tank.
Figure 3B:
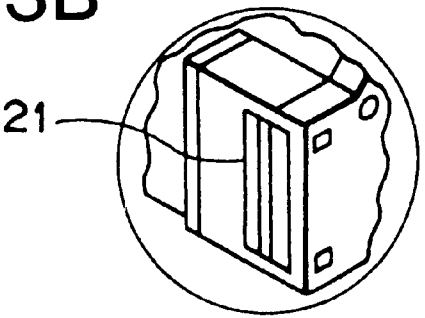
FIG. 3B is an enlarged portion thereof.

FIGS. 3A and 3B show details of the ink cartridge 1.

In FIG. 3A, reference numeral 15 denotes an exchangeable ink tank storing black (Bk) ink; 16, an exchangeable ink tank storing inks of cyan (C), magenta (M), and yellow (Y) coloring materials; 17, ink supply ports of the ink tank 16 which communicate with the ink cartridge 1 to supply inks; and 18, an ink supply port of the ink tank 15. The ink supply ports 17 and 18 are connected to a supply pipe 20 to supply inks to a printhead 21. Electrical contacts 19 are connected to the flexible cable 5 and transmit a signal based on print data to the printhead 21.

The construction of the printhead 21 will be described in detail below with reference to FIGS. 4A and 4B.

Figure 4A:
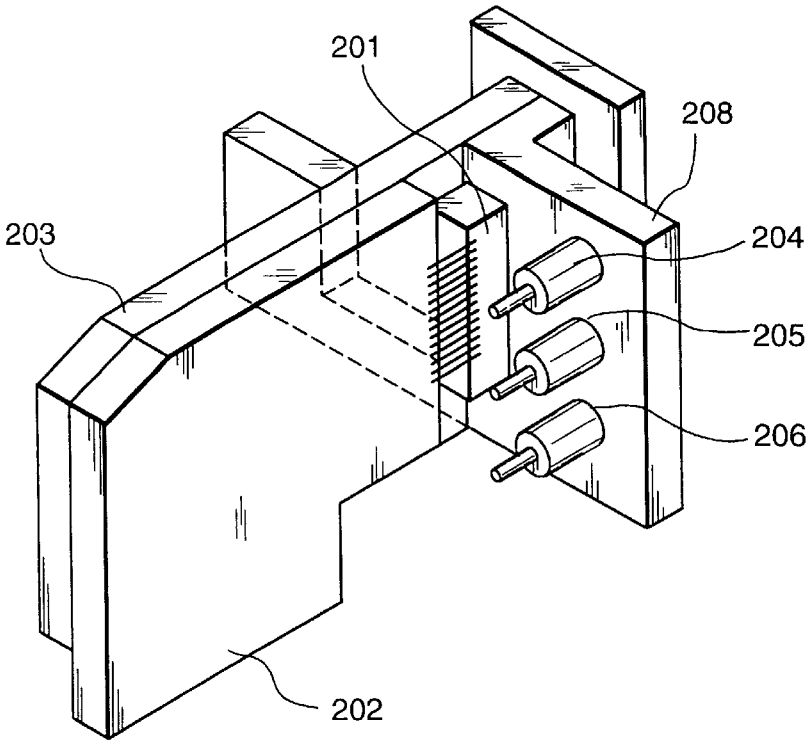
FIGS. 4A and 4B are perspective views showing the mechanism of a printhead used in the inkjet printer shown in FIG. 1.
Figure 4B:
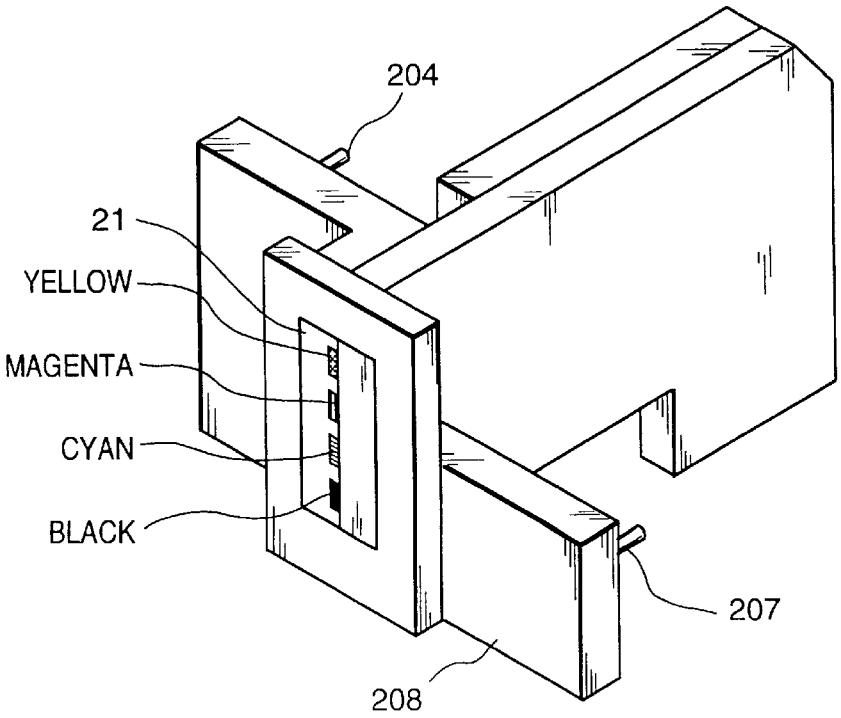

FIGS. 4A and 4B are perspective views of an outer appearance showing the structure of the printhead 21. FIG. 4A is a rear view of the printhead 21, and FIG. 4B is a front view of the printhead 21.

On the front surface of the printhead 21, nozzle groups for discharging yellow, magenta, cyan, and black inks are arranged in a line. In these nozzle groups, twenty-four orifices are provided for each of the yellow, magenta, and cyan nozzle groups, and sixty-four orifices are provided for the black nozzle group. Spacings between the orifice groups of these colors are one nozzle pitch or more.

An ink channel communicating with an orifice is provided for each of these orifices. Behind a portion where these ink channels are formed, common ink chambers for supplying inks to the ink channels are formed. An electrothermal transducer, an electrode and electrical lines are provided for each of the ink channels of the orifices. The electrothermal transducer generates thermal energy used to cause film boiling in ink and discharge ink droplets from the orifice. The electrode line supplies electric power to the electrothermal transducer. These electrothermal transducers (discharge heaters) and electrode lines are formed by a film forming technology on a substrate 201 made from, e.g., silicon. Additionally, partitions and a top plate made from a resin and a glass material are accumulated on the substrate 201 to constitute the orifices, the ink channels, and the common ink chambers. Behind the substrate 201, a print circuit board 202 integrating a driving circuit for driving the electrothermal transducers on the basis of a print signal is provided.

Alternatively, a slit top plate (orifice plate) having partitions for dividing a plurality of ink channels and common ink chambers may be adhered to the substrate without using the glass material. This orifice plate is an integrally molded product, and polysulfone is preferable as the material of integral molding. However, another molding resin material may also be used.

Pipes 204 to 207 project parallel to an aluminum plate 203 from a plastic member 208, called a distributer, which extends perpendicularly to the substrate 201. These pipes 204 to 207 communicate with flow paths inside the distributer 208, and these flow paths communicate with the common ink chambers. Four flow paths for yellow, magenta, cyan, and black exist in the distributer 208 and connect the respective common ink chambers to the pipes.

In this embodiment, the color ink tank and the black (Bk) ink tank are independently exchangeable. However, it is also possible to use an ink cartridge in which color inks are contained in separate ink tanks. About 40 ng of a yellow, magenta, or cyan ink are discharged from each orifice provided in the printhead 21, and about 80 ng of a black ink are discharged from each orifice.

Examples of components of the inks used in the inkjet printer of this embodiment are as follows.

| | | |
|---|---|---|
| 1. | Y (yellow) | |
| | C.I. Direct Yellow 86 | 3% |
| | Diethylene Glycol | 10% |
| | Isopropyl Alcohol | 2% |
| | Urea | 5% |
| | Acetylenol EH (Kawaken-Chemical) | 1% |
| | Water | 79% |
| 2. | M (magenta) | |
| | C.I. Acid Red 289 | 3% |
| | Diethylene Glycol | 10% |
| | Isopropyl Alcohol | 2% |
| | Urea | 5% |
| | Acetylenol EH (Kawaken-Chemical) | 1% |
| | Water | 79% |
| 3. | C (cyan) | |
| | C.I. Direct Blue 199 | 3% |
| | Diethylene Glycol | 10% |
| | Isopropyl Alcohol | 2% |
| | Urea | 5% |
| | Acetylenol EH (Kawaken-Chemical) | 1% |
| | Water | 79% |
| 4. | Bk (black) | |
| | C.I. Direct Black 154 | 3% |
| | Diethylene Glycol | 10% |
| | Isopropyl Alcohol | 2% |
| | Urea | 5% |
| | Water | 80% |

As shown above, the permeability of the C, M, and Y inks is improved with respect to the black (Bk) ink by adding 1% of Acetylenol EH. Other additives are a surfactant, alcohol, and the like.

A thin ink is prepared by decreasing the dye concentration in each ink composition. In this embodiment, in the case of the Bk ink contained in the ink tank 15, for example, the dye concentration is 1.5% when a two-time dilute Bk ink is used, and 1% when a three-time dilute Bk ink is used. In the case of the color ink contained in the ink tank 16, the dye concentration of Y remains 3% and those of X and C are 1.5% when a two-time dilute color ink is used. When a three-time dilute color ink is used, the dye concentration of Y remains 3% and those of M and C are 1%.

Figure 5:
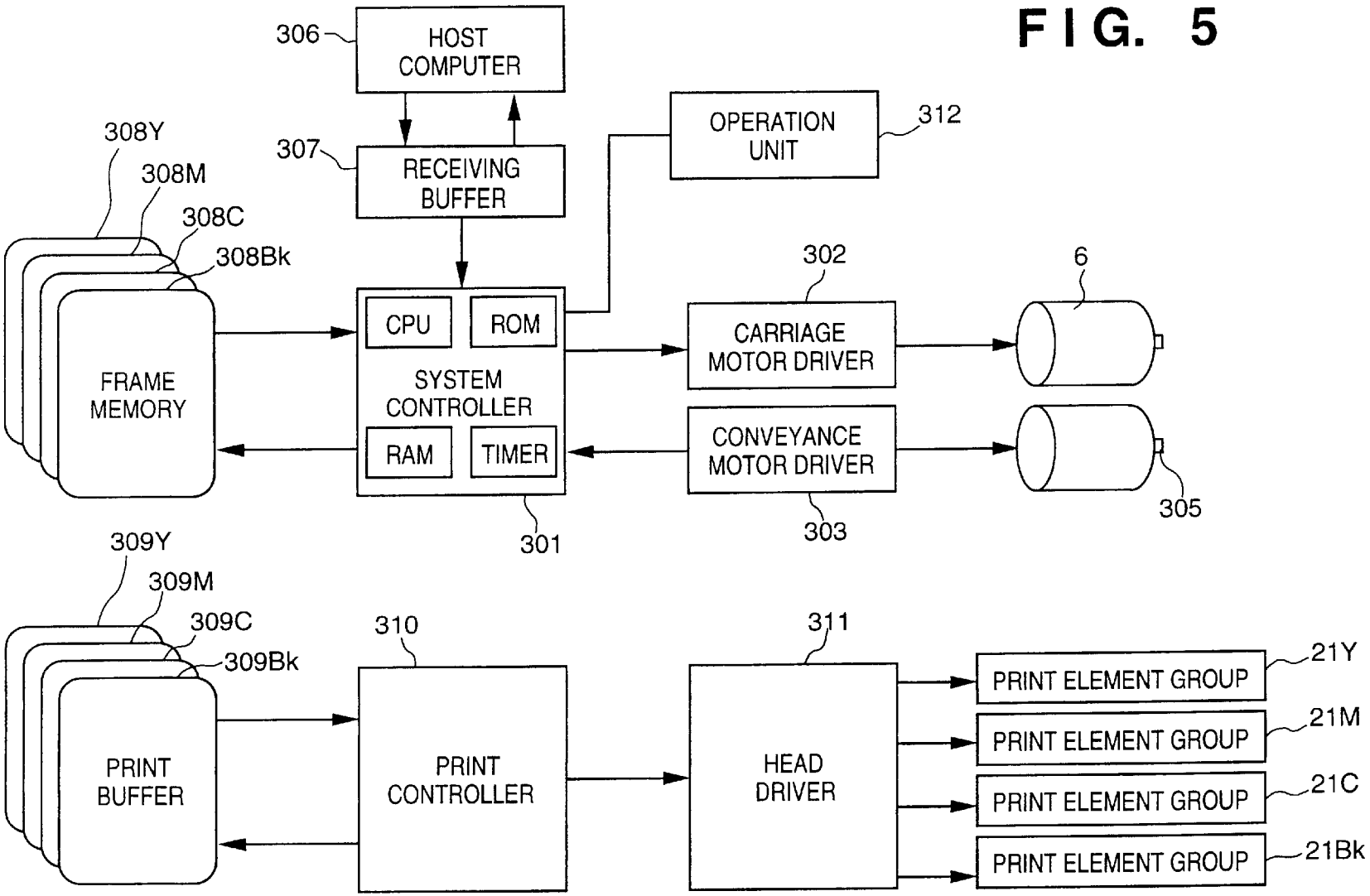
FIG. 5 is a block diagram showing the configuration of a control circuit in the inkjet printer shown in FIG. 1.

FIG. 5 is a block diagram showing an electrical control configuration in the inkjet printer of this embodiment.

In FIG. 5, reference numeral 301 denotes a system controller for controlling the entire inkjet printer. The system controller 301 includes a microprocessor (CPU), a storage device (ROM) storing control programs, a storage device (RAM) with which the microprocessor executes control programs, a timer for measuring time in accordance with an instruction from the CPU, and the like. A carriage motor driver 302 rotates the carriage motor 6 to scan the carriage unit 2 in the main scan direction in accordance with an instruction from the system controller 301. Likewise, a conveyance motor driver 303 rotates a conveyance motor 305 to convey a print paper as a printing medium in a sub-scan direction in accordance with an instruction from the system controller 301. A host computer 306 transmits print data to this inkjet printer. A receiving buffer 307 temporarily stores the print data received from the host computer 306. A frame memory 308 stores image data (bit images) corresponding to the individual colors. The frame memory 308 has a memory size necessary to print an image in these colors. In this embodiment, it is assumed that this frame memory can store print data of one print paper (one page). However, the present invention is not limited by the size of the frame memory.

A print buffer 309 temporarily stores print data corresponding to the individual colors. The capacity of the print buffer corresponding to the individual colors changes in accordance with the number of orifices (nozzles) in the printhead 21. A print controller 310 appropriately controls the printhead 21 in accordance with an instruction from the system controller 301. For example, the print controller 310 controls the discharge rate and the number of print data. A head driver 311 controls driving of print element groups 21Y, 21M, 21C, and 21Bk, each corresponding to Y, M, C and Bk ink. The head driver 311 is controlled by a signal from the print controller 310. An operation unit 312 includes various keys operated by a user and a display unit for displaying various messages and error messages to the user.

Figure 6B:
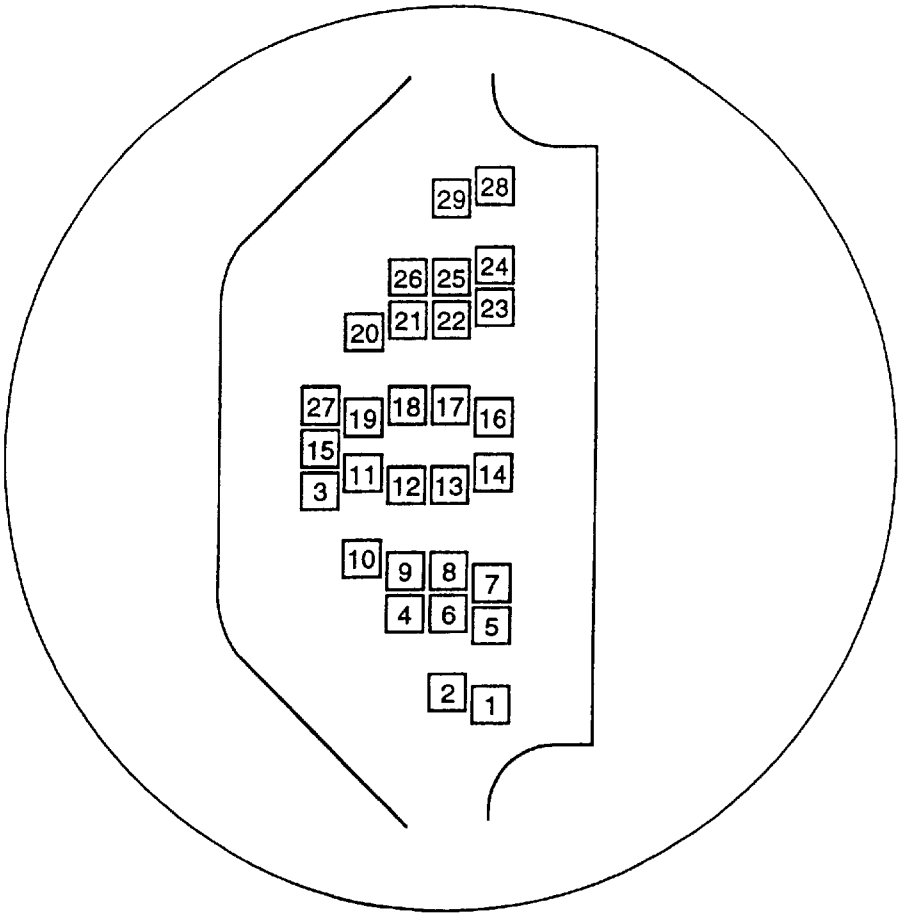
FIG. 6B is an enlarged portion thereof.
Figure 6A:
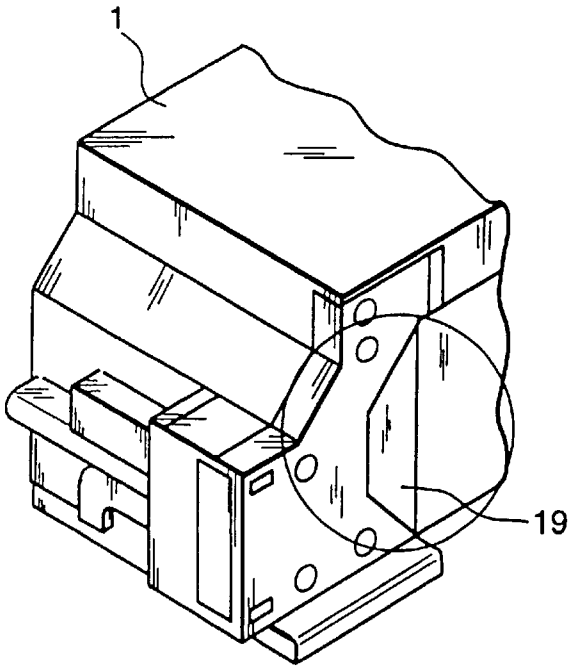
FIG. 6A is a perspective view for explaining details of electrical contacts of the printhead.

FIGS. 6A and 6B show details of the electrical contacts 19 of the ink cartridge 1 of the inkjet printer.

Through the electrical contacts 19, a signal related to ink discharge, an ID signal as information for identifying the ink cartridge 1 or the ink tank attached, and the like are transmitted to the printer main unit.

FIGS. 7A and 7B are views for explaining a method of detecting the type of an ink tank attached to the ink cartridge 1.

The ink tank 15 (16) is attached to the ink cartridge 1 and fixed on the ink cartridge 1 when a hook 70 engages with a projection 73 of the tank. Contacts 71 for detecting the type of the attached ink tank are provided in a direction in which the force of the hook 70 acts. These tank type detecting contacts 71 are provided on both the ink cartridge 1 and the ink tank 15 (16). Reference numeral 72 of FIG. 7B shows the contacts 71 of the ink tank 15 (16) in an enlarged scale. As shown, three electrode pads 1, 2, and 3 are formed. Although not shown, the same number of analogous electrode pads are formed on the ink cartridge 1 and electrically connected in the contacts 71. In the contacts 71 of the ink tank 15 (16), the electrode pads 1 and 2 can be rendered conductive, but the electrode pad 3 is insulated. For example, this state corresponds to an ink tank containing a regular ink. The inkjet printer can detect the type of an ink contained in an attached ink tank by supplying an electric current to these electrode pads via the contacts 71 of the ink cartridge 1 in contact with the electrode pads.

That is, in the example shown in FIGS. 7A and 7B, a current flows between the electrode pads 1 and 2 but does not flow between the electrode pads 1 and 3 or between the electrode pads 2 and 3. This state is stored as information indicating a regular ink tank in the ROM of the inkjet printer in advance. On the other hand, the electrode pad 3 is rendered conductive for an ink tank containing a thin ink. This allows this ink tank to be distinguished from a regular ink tank.

In this embodiment, the number of electrode pads for identifying an ink tank is 3. However, a larger number of types of ink tanks can be identified by increasing the number of these electrode pads.

Furthermore, it is also possible to detect whether or not the ink cartridge 1 or the ink tank has been exchanged by checking the conducting state via the electrical contacts 19 shown in FIGS. 6A and 6B.

Several embodiments of a recovery operation concerning ink tank exchange using the inkjet printer with the above structure will be described below.

[First Embodiment]

In this embodiment, a method of setting optimum recovery conditions for each individual ink tank in an ink tank exchange sequence will be described.

Figure 8:
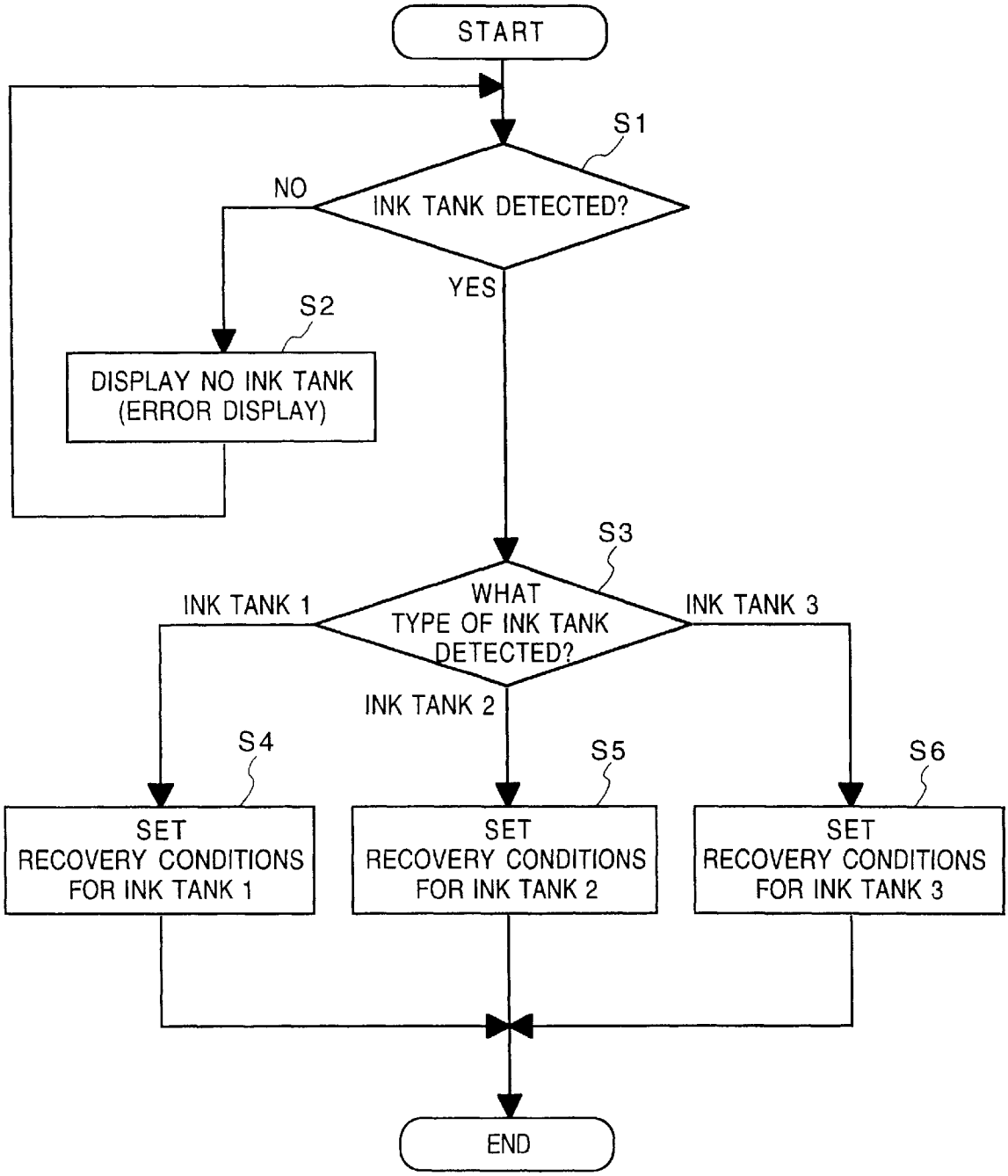
FIG. 8 is a flow chart showing ink tank exchange processing according to a first embodiment of the present invention.

FIG. 8 is a flow chart showing ink tank exchange control executed by the inkjet printer. A control program for executing this processing is stored in, e.g., the ROM of the system controller 301 and executed under the control of the CPU of the system controller 301.

In step S1, the CPU checks whether or not an ink tank is attached to the ink cartridge 1. If no ink tank is attached, the flow advances to step S2, and the CPU displays information indicating there is no ink tank on the display unit of the operation unit 312, thereby prompting the user to attach an ink tank. The flow returns to step S1, and the CPU again checks the presence/absence of an ink tank. Note that whether or not an ink tank is attached can be readily checked by supplying an electric current to the electrode pads of the electrical contacts 19 explained with reference to FIG. 6.

If the CPU determines in step S1 that an ink tank is attached, the flow advances to step S3, and the CPU detects the type of the attached ink tank. This detection of the ink tank type is done by the method explained with reference to FIG. 7. In accordance with the type of the ink tank detected in step S3, the flow advances to one of steps S4 to S6, and the CPU sets recovery conditions corresponding to the ink tank. Consequently, optimum recovery conditions for the attached ink tank can be set.

FIG. 9 shows examples of recovery conditions for three types of ink tanks ("ink tank 1" to "ink tank 3") shown in FIG. 8.

Assume that "ink tank 1" contains a regular ink, "ink tank 2" contains an ink diluted a maximum of two times, and "ink tank 3" contains an ink diluted a maximum of three times.

(1) Number of Times of Suction Recovery after Tank Exchange

Figure 2:
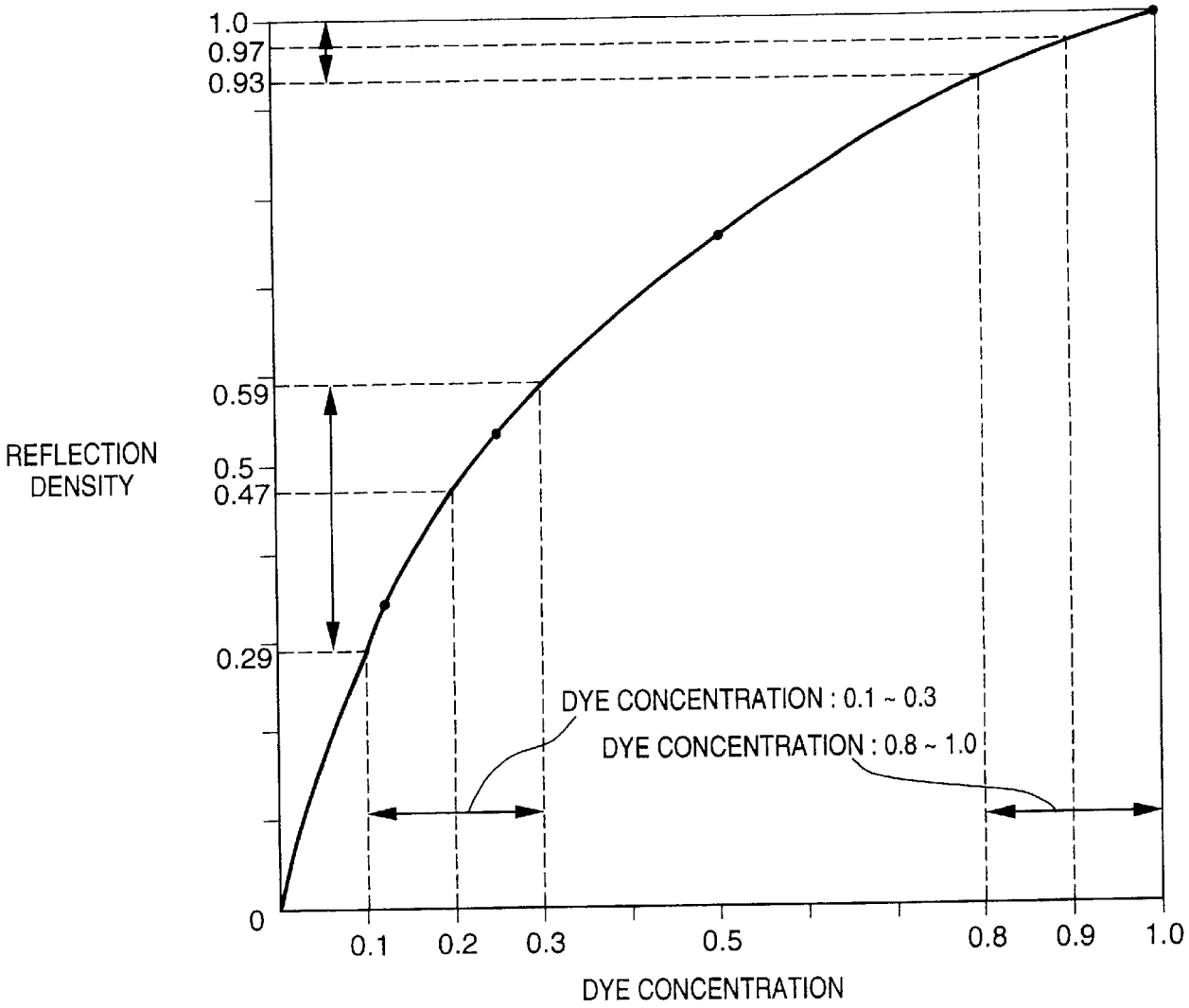
FIG. 2 is a graph showing the optical reflection density of an ink as a function of dye concentration of the ink.

As already described with reference to FIG. 2, a thin ink greatly changes its reflection density with a change in dye concentration compared to an ink with a normal density. Therefore, when an ink tank containing a thin ink is to be newly attached, ink tank exchange must be so performed as to minimize the influence of the ink used before exchange and still remaining in the printhead 21. To this end, it is necessary to completely fill the printhead 21 with the ink contained in the newly attached ink tank before printing is performed. Accordingly, the smaller the dye concentration of ink to be used becomes, the greater the number of times of suction during ink tank exchange should become.

On the other hand, in suction recovery executed after a new ink tank is attached and an ink of this ink tank is used in printing, the number of times of suction is 1 regardless of the ink density. That is, the number of times of suction is changed in accordance with the type of an ink tank such that the smaller the dye concentration of the ink becomes, the greater the number of times of suction in ink tank exchange becomes only when an ink tank is exchanged for an ink tank of a different kind. It is unnecessary to increase the number of times of suction in suction recovery which is intermittently executed while the printer is normally used. Also, when ink tanks of the same kind are exchanged, inks having the same dye concentration are used. Therefore, it is unnecessary to increase the number of times of suction even in ink tank exchange.

Accordingly, when ink tank exchange is performed according to the procedure as shown in FIG. 8 and this exchange is for an ink tank of a different kind, the number of times of suction corresponding to the type of the ink tank as shown in FIG. 9 is set.

Consequently, it is possible to set a proper number of suction recovery times corresponding to the type of the ink tank in ink tank exchange. This prevents unnecessary suction recovery from being performed and eliminates wasteful consumption of ink.

(2) Number of Times of Preliminary Discharge after Wiping

A thin ink is more susceptible to the influence of an ink having an increased viscosity resulting from wiping (cleaning of the front surface of a printhead). From this point of view, when an ink tank containing a thin ink is newly attached, the number of times of preliminary discharge after wiping is increased. This minimizes the density variation of the thin ink after wiping.

(3) Preliminary Discharge Intervals during Printing

During a print operation, nozzles which do not discharge an ink are easily dried to cause a density variation. Since a thin ink is more susceptible to the influence of this density variation, shorter intervals of preliminary discharge are set for an ink having a lower dye concentration.

(4) Number of Times of Preliminary Discharge during Printing

As described above, as the dye concentration of an ink decreases, the intervals of preliminary discharge during printing are shortened. Therefore, when an ink tank containing a thin ink is attached, the number of preliminary discharge times is decreased in accordance with the decrease in the preliminary discharge interval. In this way, total numbers of preliminary discharge times per unit time for different ink tanks are made almost equal. For example, assuming that the unit time is 1 min. (60 sec.), preliminary discharge is performed 5 times (60/12=5) and a total of 75 (=5×15) times for "ink tank 1". For "ink tank 2", preliminary discharge is performed about 7 times (60/8=7.5) and a total of 77 times. For "ink tank 3", preliminary discharge is performed 10 times (60/6=10) and a total of 80 times. Consequently, the numbers of preliminary discharge times per 1 min. for these ink tanks are almost the same.

The processing of identifying the type of an ink tank attached to the ink cartridge 1 will be described in detail below.

Figure 10:
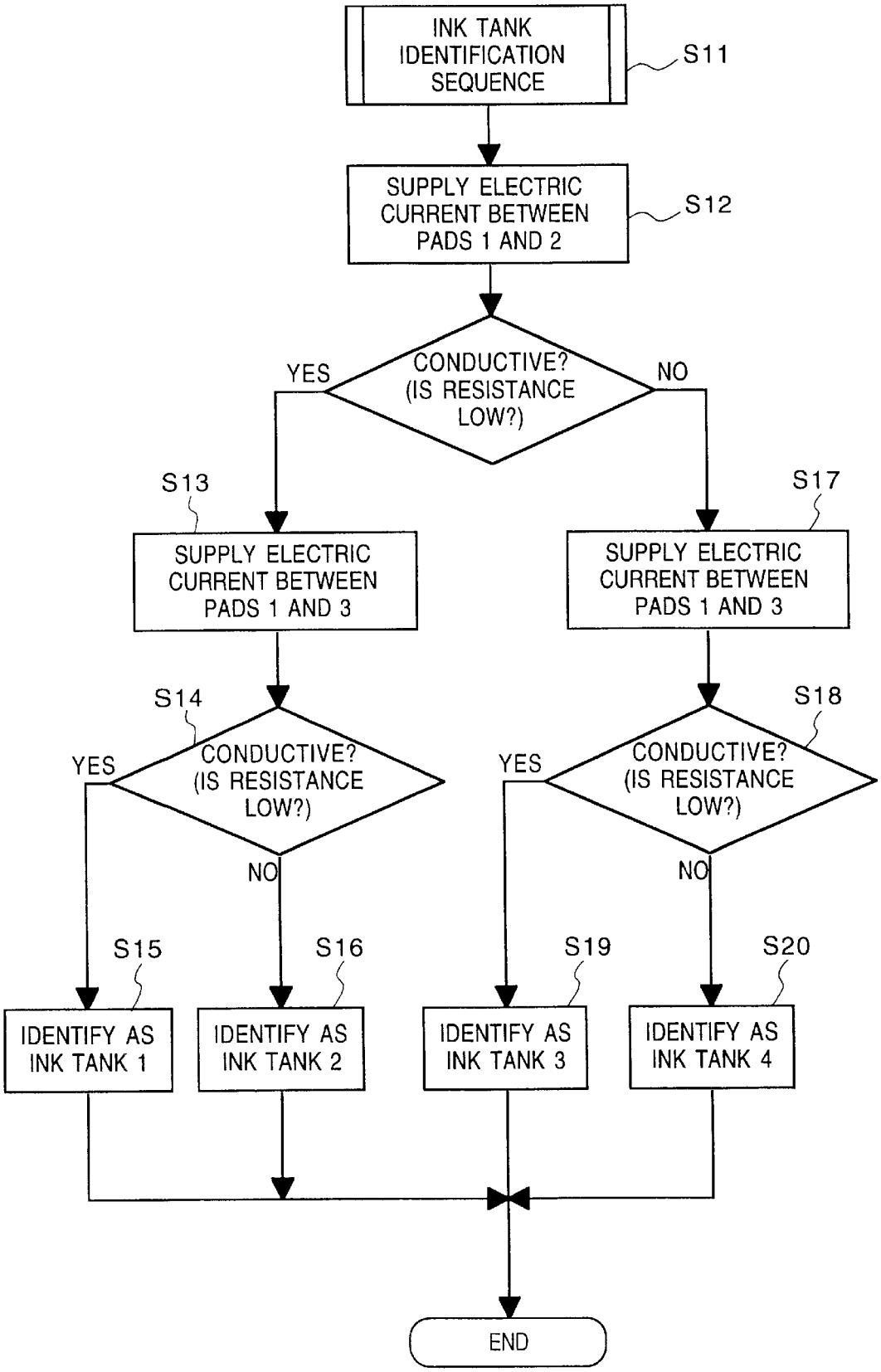
FIG. 10 is a flow chart showing ink tank identification processing according to the first embodiment of the present invention.

FIG. 10 is a flow chart showing processing of identifying the type of an ink tank attached to the ink cartridge 1 when the number of electrode pads of the contact 71 is "3". This processing corresponds to the processing in step S3 of FIG. 8. Assume that the electrode pad 1 can always be rendered conductive and the type of the attached ink tank is identified in accordance with the states of the electrode pads 2 and 3.

In step S11, a voltage is applied between the electrode pads 1 and 2. In step S12, whether or not a current flows between these electrode pads 1 and 2 applied with the voltage is checked. This is actually done by checking whether the resistance when the voltage is applied is relatively high (insulated state) or relatively low (conductive state).

If it is determined in step S12 that these electrode pads are rendered conductive, the flow advances to step S13, and a voltage is applied between the electrode pads 1 and 3. In step S14, whether or not a current flows between these electrode pads 1 and 3 is checked. If it is determined that the electrode pads 1 and 3 are rendered conductive, the flow advances to step S15. Since all the electrodes are rendered conductive in this case, the attached ink tank is identified as "ink tank 1". If it is determined in step S14 that the electrode pads 1 and 3 are not rendered conductive, the flow advances to step S16. In step S16, it is determined that only the electrode pad 3 is insulated, and the ink tank is identified as "ink tank 2".

On the other hand, if it is determined in step S12 that the electrode pads 1 and 2 are not rendered conductive, the flow advances to step S17, and a voltage is applied between the electrode pads 1 and 3 as in step S13. In step S18, whether or not these electrode pads 1 and 3 are rendered conductive is checked. If it is determined that the electrode pads 1 and 3 are rendered conductive, the flow advances to step S19, and the ink tank is identified as "ink tank 3", by determining that only the electrode pad 2 is insulated. If it is determined in step S18 that the electrode pads 1 and 3 are not rendered conductive, it is determined that both the electrode pads 2 and 3 are insulated. In step S20, the ink tank is identified as "ink tank 4". Note that if the determination in step S1 of FIG. 8 is not performed, it is also possible to determine in step S20 that no ink tank is attached.

As described above, the type of an ink tank attached to the ink cartridge 1 can be identified by checking the conductive states of the contacts 71.

In this embodiment as described above, optimum recovery conditions for an ink contained in an attached ink tank can be set by identifying the type of the ink tank.

Consequently, simply by exchanging an ink tank for an ink tank containing an ink with a different density, high-quality color images can be formed in accordance with the dye concentration of the ink without being affected by the density of an ink contained in the previously attached ink tank.

In this first embodiment, the type of an attached ink tank is identified. In a printer having no such detecting means, however, a user specifies the type of an ink in an ink tank by using, e.g., the operation unit 312 so that the printer can set a suction recovery operation corresponding to the specified type. Consequently, high-quality printing using inks with a plurality of different dye concentrations can be performed by using ink tanks containing inks with different densities.

[Second Embodiment]

In this embodiment, a process of preventing a density variation occurrence when a thin ink dries in the nozzles, and particularly preliminary discharge driving control will be described.

As described previously, the reflection density of a thin ink largely varies with a slight variation in the dye concentration. Nozzles not discharging an ink in the printhead 21 dry very easily, so it is necessary to perform preliminary discharge for these nozzles earlier than nozzles discharging an ink. When a thin ink is used, the dye concentration of the ink is low, so a larger amount of ink is discharged accordingly in order to obtain an image density equivalent to an image density obtained when printing is performed by a regular ink. For example, when a 3-times dilute thin ink is used, it is necessary to perform printing by tripling the number of ink discharge times per one pixel in order to print images with an image density equivalent to that when the regular ink is used. Accordingly, the ink consumption amount is increased when the thin ink is used, so unnecessary ink discharge other than ink discharge used in image printing must be avoided as much as possible.

In this embodiment, therefore, the nozzle array of the printhead 21 is divided into blocks, and the preliminary discharge timing is controlled in units of blocks.

Figure 11:
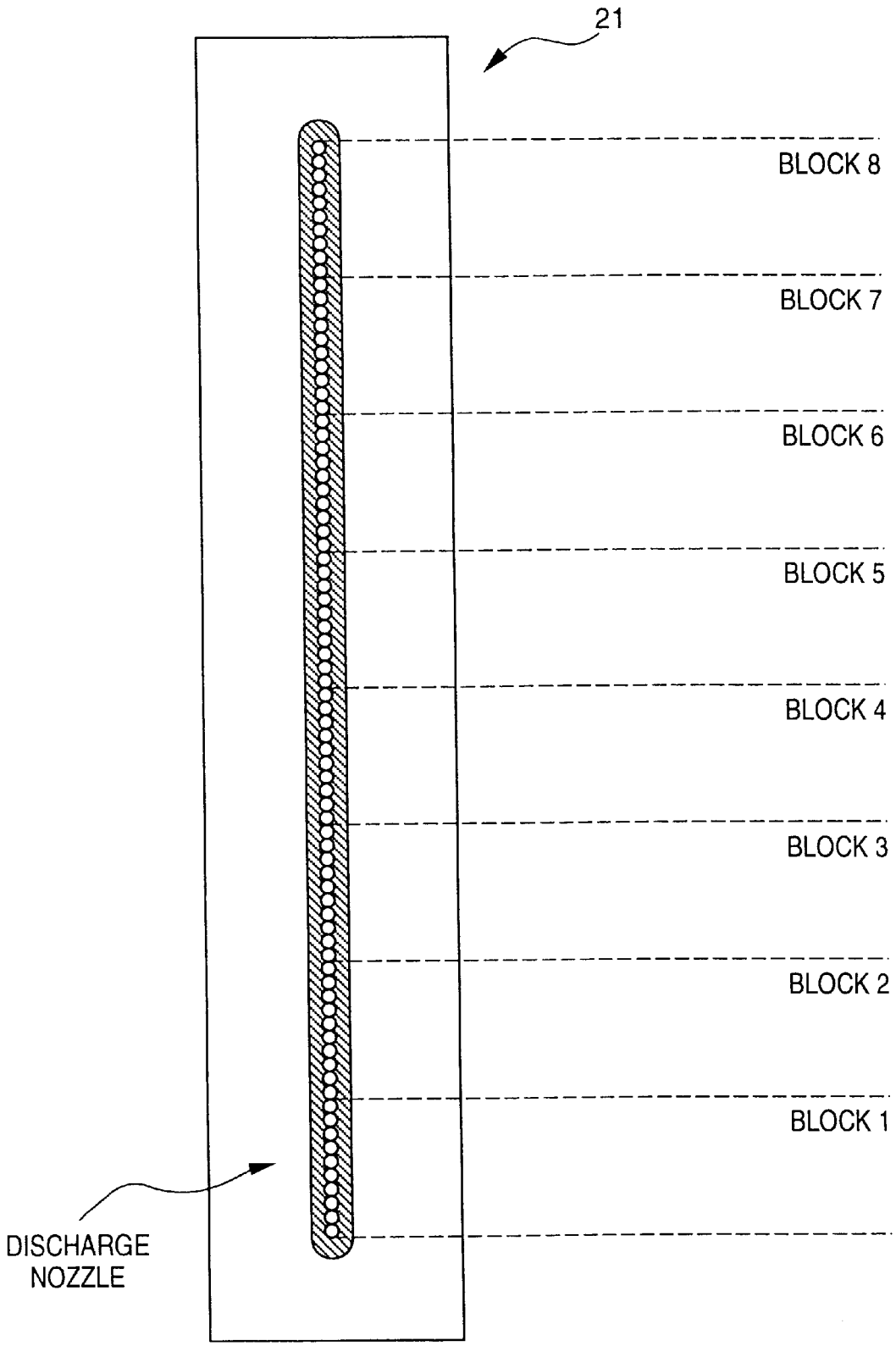
FIG. 11 is a view showing block division of all nozzles of a printhead according to a second embodiment of the present invention.

FIG. 11 shows the way all nozzles in the printhead 21 are divided into a plurality of blocks in accordance with this embodiment.

In this embodiment, all nozzles in the printhead 21 are divided into eight blocks. The CPU of the system controller 301 uses the timer to measure the elapsed time from the latest ink discharge for each block. When the measured time for a certain block becomes a certain value or more, e.g., 12 sec. or more, at a timing when preliminary discharge is executed only for the block of interest, the carriage unit 2 moves close to a position where preliminary discharge can be executed.

Figure 12:
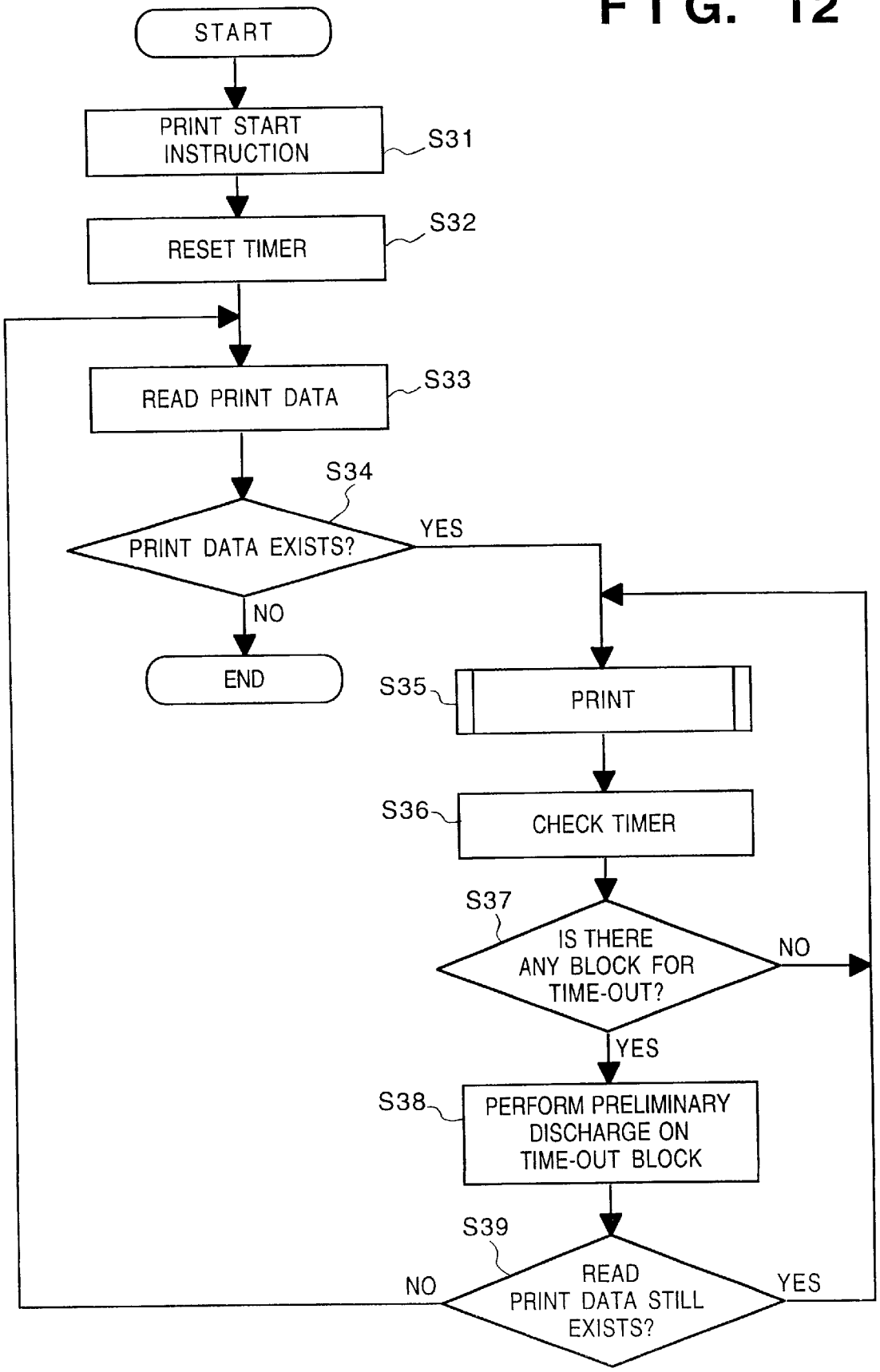
FIG. 12 is a flow chart showing preliminary discharge processing including print processing according to the second embodiment of the present invention.

FIG. 12 is a flow chart showing the preliminary discharge control processing executed in accordance with this embodiment. A control program for executing this processing is stored in the ROM of the system controller 301.

In step S31, the CPU receives a print start instruction from the host computer 306. The flow advances to step S32, and the CPU resets timer values (to be described later with reference to FIG. 14), stored in the system controller 301, corresponding to the individual blocks. The flow advances to step S33, and the CPU starts reading received data stored in the receiving buffer 307. The receiving buffer 307 generally has a memory capacity capable of storing print data which the printhead 21 prints by scanning a plurality of times. The flow then advances to step S34, and the CPU checks whether or not the read data contains print data.

If the CPU determines that print data exists, the flow advances to step S35, and the CPU develops the print data into a bitmapped image and outputs the bitmapped image to the printhead 21 in synchronism with the scan of the carriage unit 2, thereby printing the image.

Figure 13:
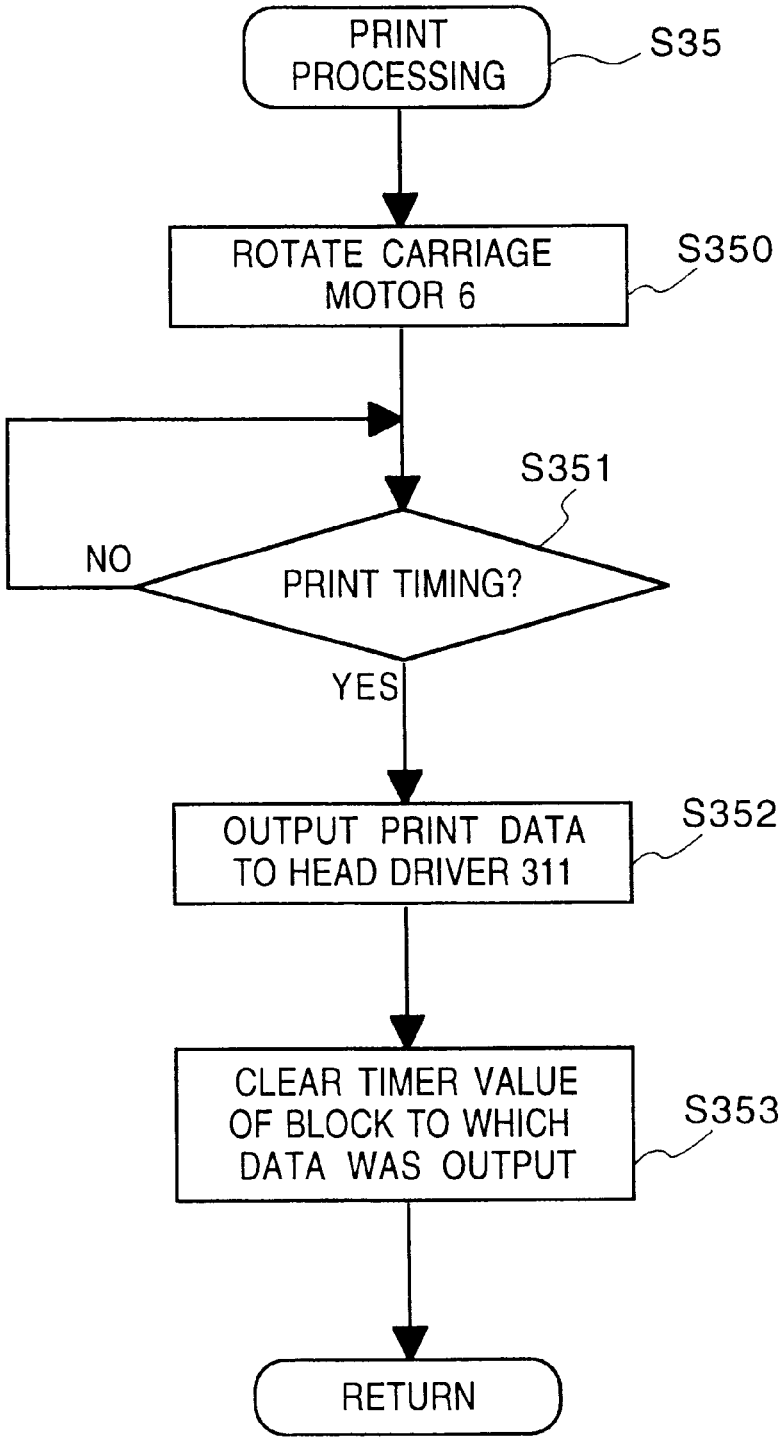
FIG. 13 is a flow chart showing the print processing according to the second embodiment of the present invention.

Details of the print processing in step S35 are shown in a flow chart of FIG. 13.

The print processing will be described with reference to FIG. 13. In step S350, the CPU rotates the carriage motor 6 to scan the carriage unit 2. In step S351, the CPU checks whether or not a print timing is reached. If the CPU determines that the print timing is reached, the flow advances to step S352, and the CPU outputs print data for one scan of the printhead 21 to the head driver 311. The flow advances to step S353, and the CPU clears only the timer value of a nozzle block in the printhead to which the data was output.

FIG. 14 shows an example of the format of a table, storing block numbers and timer values in a one-to-one correspondence with each other, provided in the RAM of the system controller 301.

In FIG. 14, all nozzles in the printhead 21 are divided into eight blocks in accordance with the block division shown in FIG. 11. Assume that these timer values are updated at all times by another program on the basis of the time measurement by the timer of the system controller 301.

After the print operation in step S35 is complete, therefore, the flow advances to step S36, and the CPU executes timer check by referring to the table shown in FIG. 14.

Thereafter, the flow advances to step S37, and the CPU checks on the basis of the timer check in step S36 whether or not there is a block whose timer value is equivalent to the value of time-out. If the CPU determines that there is no such block, the flow returns to step S35, and the CPU executes the above processing. If the CPU determines, on the other hand, that there is a block whose timer value indicates time-out, the flow advances to step S38, and the CPU executes preliminary discharge for nozzles included in that block. After preliminary discharge is thus executed, the CPU clears the timer value corresponding to the block for which preliminary discharge has just been performed. The flow advances to step S39, and the CPU checks whether or not the received print data is completely printed. If the CPU determines that printing is not complete, the flow returns to step S35, and the CPU executes the above processing. If the CPU determines that printing is complete, the CPU performs processing such as "renew paper (paper discharge)", and the flow advances to step S33. In step S33, the CPU starts reading received data of the next page from the receiving buffer 307.

In this embodiment, timer values are reset at the timing of the print start instruction. However, timer values can also be reset at the timing of wiping or suction recovery.

In this embodiment as described above, all nozzles in the printhead are divided into a plurality of blocks, and whether or not preliminary discharge is performed is controlled on the basis of the use interval of each block. This minimizes the influence of an ink density variation due to drying of nozzles. In particular, a variation of the dye concentration of a thin ink during printing can be minimized.

Consequently, high-quality images can be printed even when the images are printed with a thin ink by using nozzles not frequently used.

[Third Embodiment]

In this embodiment, ink tank exchange processing will be described for a case where, when ink tanks are to be exchanged, an ink used before exchange is completely removed from the printhead 21 and then a new ink tank is attached, thereby minimizing the influence of the ink remaining in the printhead 21.

In this embodiment, when an ink tank is detached for exchange, suction recovery is performed for the printhead 21 to remove the residual ink from the printhead 21. When a new ink tank is attached, suction recovery is again performed for the printhead 21 in this state. Consequently, the influence of the residual ink before ink tank exchange can be minimized. The operation in this embodiment is basically executed by an operation by a user who intends to exchange ink tanks.

Figure 15:
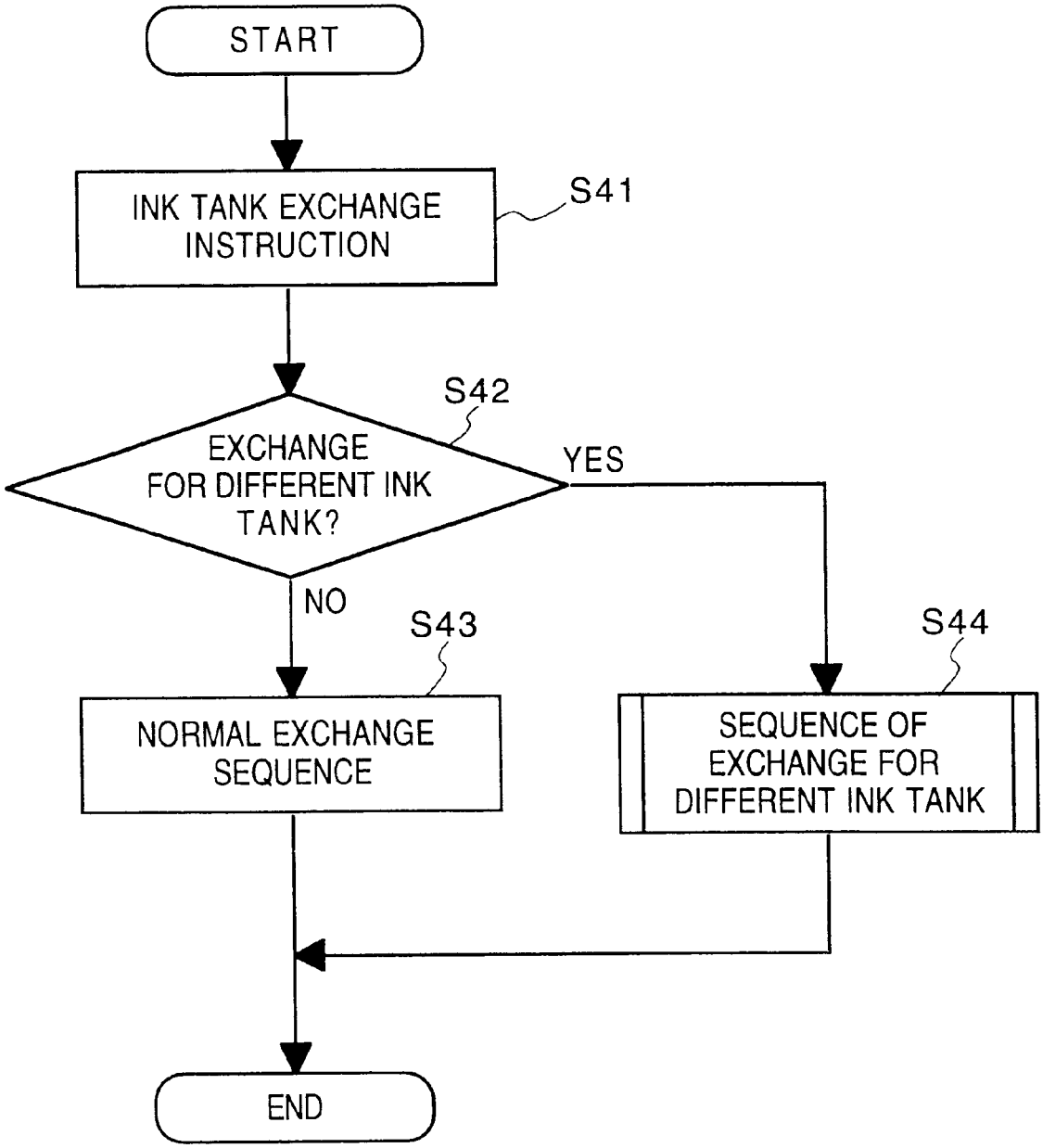
FIG. 15 is a flow chart showing ink tank exchange processing according to a third embodiment of the present invention.

FIG. 15 is a flow chart showing the ink tank exchange processing executed by the system controller 301 in accordance with this embodiment.

In step S41, a user inputs an ink tank exchange instruction from the operation unit 312. Then, the flow advances to step S42, and the CPU of the system controller 301 checks whether or not this ink tank exchange indicates exchange for an ink tank containing an ink of a different kind. As described earlier, the printer can check the type of an ink tank currently attached, and the user can specify the type of an ink tank to be newly attached by exchange by, e.g., a key operation on the operation unit 312. If the ink tank to be newly attached by exchange is the same type as the current ink tank, the flow advances to step S43, and the CPU executes a suction recovery operation following a conventionally known common exchange sequence.

If the current ink tank is to be exchanged for an ink tank of a different kind, the flow advances from step S42 to step S44, and the CPU executes a suction recovery operation according to a sequence of exchange for an ink tank of a different kind.

Figure 16:
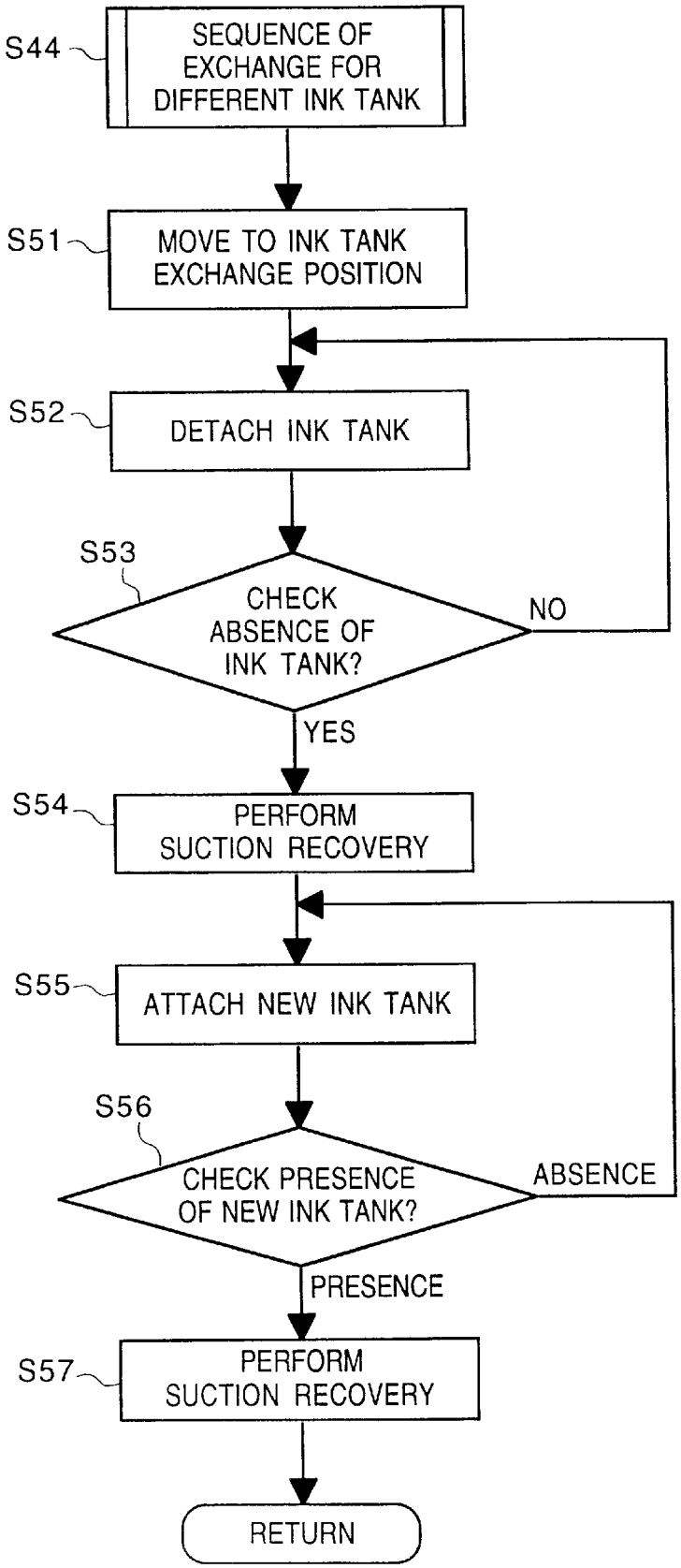
FIG. 16 is a flow chart showing processing of exchange for a different ink tank according to the third embodiment of the present invention.

FIG. 16 is a flow chart for explaining the suction recovery operation according to the sequence of exchange for an ink tank of a different kind.

In step S51, the carriage motor 6 is rotated to move the carriage unit 2 to a position (home position) where ink tanks can be exchanged. The flow advances to step S52, and the CPU instructs the user to remove an ink tank. In this embodiment, a message prompting the user to remove an ink tank is displayed on the operation unit 312. In step S53, the CPU checks whether or not the ink tank is detached from the printhead 21. If the ink tank is not detached, the flow returns to step S52 to prompt the user to detach the ink tank.

If the CPU confirms in step S53 that the ink tank has been detached, the flow advances to step S54, and the CPU performs suction recovery for the printhead 21 with no ink tank being attached, thereby removing the residual ink as much as possible from the printhead 21. Since this suction recovery is done by assuming that there is no ink tank, it is unnecessary to perform wiping or preliminary discharge after the suction recovery. On the contrary, it is preferable not to perform preliminary discharge because no ink tank is attached.

The flow then advances to step S55, and the CPU instructs the user to attach an ink tank. In this embodiment, a message prompting the user to attach a new ink tank is displayed on the operation unit 312. The flow advances to step S56, and the CPU checks whether or not a new ink tank is attached. If no new ink tank is attached, the flow returns to step S55, and the CPU prompts the user to attach a new ink tank. If the CPU confirms in step S56 that a new ink tank has been attached, the flow advances to step S57, and the CPU performs suction recovery for the printhead 21 with the new ink tank being attached, thereby well filling the printhead 21 with an ink of the newly attached ink tank. Thereafter, the CPU completes the processing sequence.

In this embodiment as described above, when an ink tank is to be exchanged for an ink tank containing an ink of a different kind, the residual ink in the printhead is removed, and the printhead is filled with an ink contained in a newly attached ink tank. This minimizes the influence of the residual ink in the printhead when ink tank exchange is performed.

Also, a new ink tank is attached after suction recovery is performed for the printhead with no ink tank being attached. Consequently, an ink in the printhead can be replaced with a new ink while the amount of ink consumed by suction recovery in ink tank exchange is decreased.

Additionally, as in the previous embodiments, even when a plurality of ink tanks containing inks with different dye concentrations are used interchangeably, high-quality images can be printed only by exchanging an ink tank for an ink tank containing an ink with a different density, without being affected by the influence of the ink used before exchange.

[Fourth Embodiment]

The printhead and the ink tank can be separated in the ink cartridge used in the common printer described above. In this embodiment, suction recovery when an ink cartridge in which an ink tank and a printhead are integrally formed is used will be described.

Figure 17:
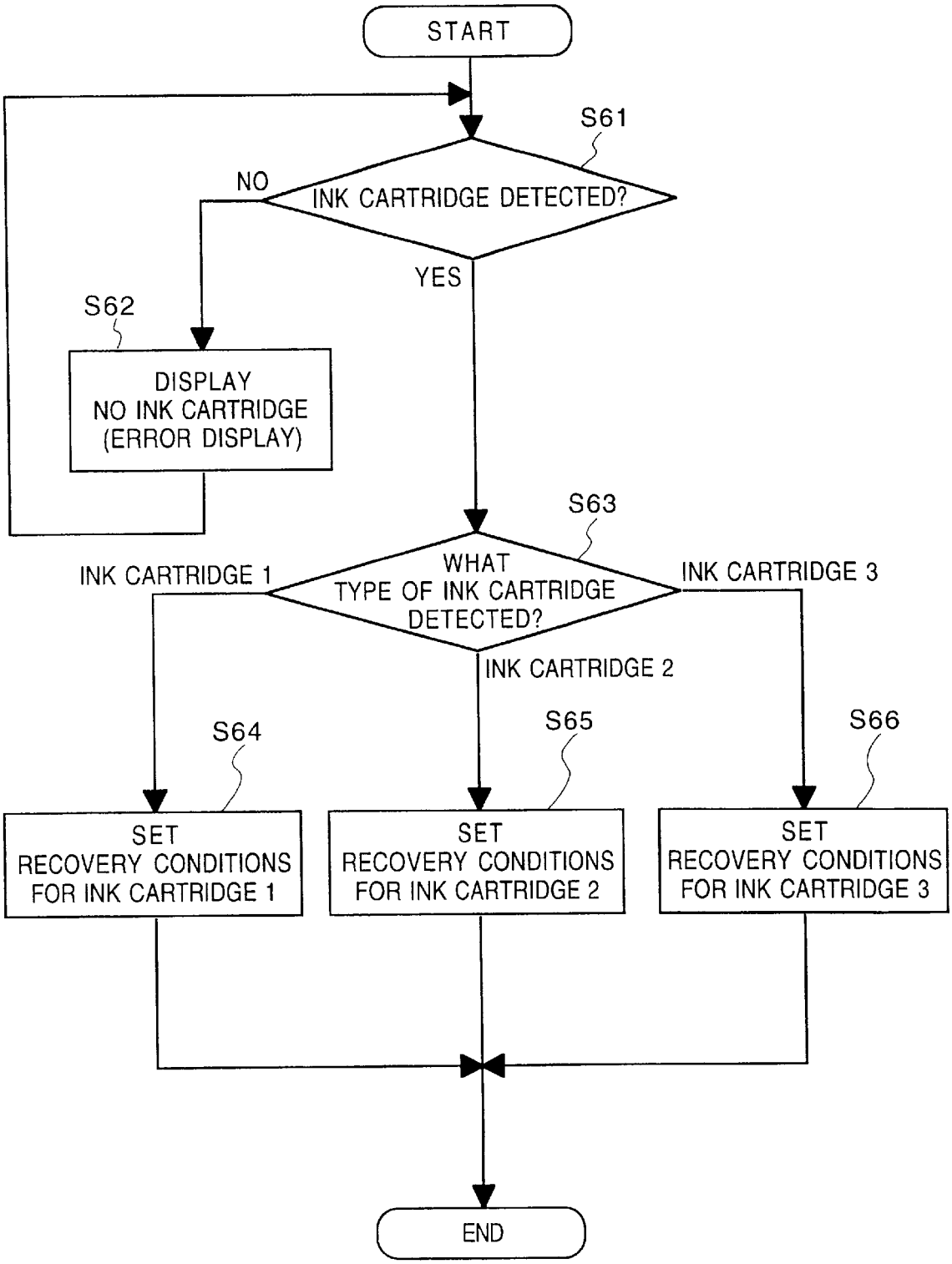
FIG. 17 is a flow chart showing ink cartridge exchange processing in an inkjet printer according to a fourth embodiment of the present invention.

FIG. 17 is a flow chart showing ink cartridge exchange processing according to this embodiment. The printer structure in this embodiment is the same as above except that the printhead and the ink tank are integrally formed in the ink cartridge.

The processing shown in FIG. 17 is basically identical to the processing shown in the flow chart of FIG. 8. In step S61, whether an ink cartridge is attached or not is detected. If no ink cartridge is attached, a message indicating there is no ink cartridge is displayed on the display unit of the operation unit 312, thereby prompting a user to attach an ink cartridge. The flow then returns to step S61 to detect the presence/absence of an ink cartridge.

On the other hand, if an ink cartridge is attached, the flow advances to step S63, and the type of the attached ink cartridge is detected. In this embodiment, the presence/absence and type of an ink cartridge are detected by using a method which identifies an ink cartridge by rendering a predetermined electrode (pad) of the electrode pads of the electrical contacts 19 of the ink cartridge shown in FIG. 6 conductive or nonconductive.

The flow advances to one of steps S64 to S66 in accordance with the type of the ink cartridge thus identified in step S63, and optimum recovery conditions for the type of the attached ink cartridge are set. In this manner, optimum recovery conditions for the type of the attached ink cartridge can be set.

FIG. 18 shows examples of recovery conditions for three different ink cartridges. As in the first embodiment, "ink cartridge 1" contains a regular ink, "ink cartridge 2" contains an ink diluted a maximum of two times, and "ink cartridge 3" contains an ink diluted a maximum of three times.

(1) Suction Recovery after Ink Cartridge Exchange

A thin ink changes its reflection density largely with a change in density concentration compared to the regular ink. Therefore, when an ink cartridge is to be exchanged for an ink cartridge containing a thin ink, if the ink before exchange remains inside the cap member of the inkjet printer, ink convection caused in the cap member by suction recovery sometimes has an influence on the density of an ink in nozzles of the printhead.

Figure 20:
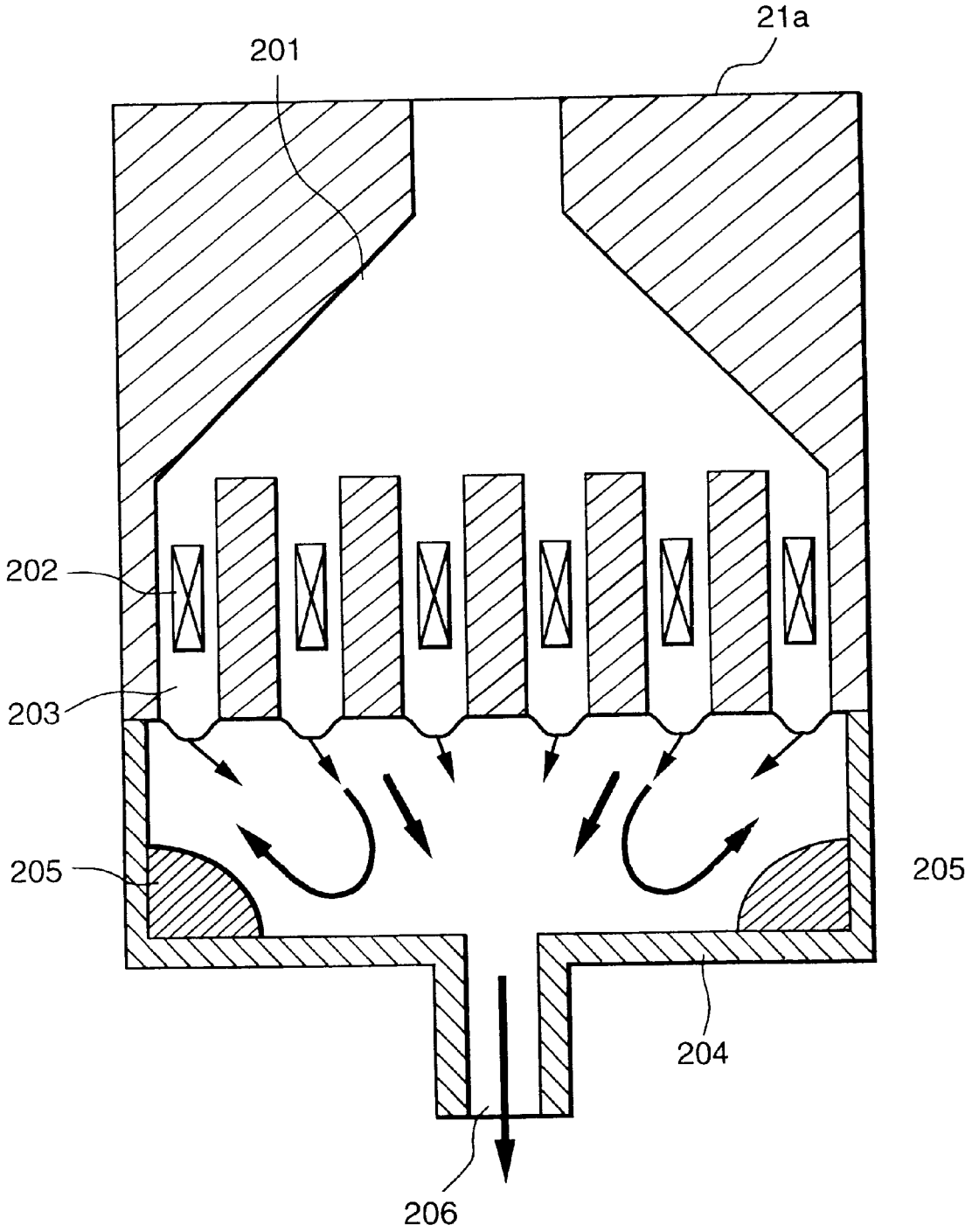
FIG. 20 is a view for explaining ink convection in a cap member upon suction recovery according to the fourth embodiment of the present invention.

FIG. 20 is a view for explaining ink convection in a cap member 204 of a printhead 21*a* when suction recovery is performed.

Print elements (discharge heaters) 202 are provided in a one-to-one correspondence with nozzles 203 of the printhead 21*a*. Each print element generates heat and foams an ink on the print element. Since the ink volume is increased by this foaming, the ink is discharged from the nozzle 203.

When a printhead recovery operation is to be performed, the cap member 204 in tight contact with the printhead 21*a* is coupled to a suction pump (not shown). An ink inside the cap member 204 and in the printhead 21*a* can be drawn by suction and discharged to the outside through the cap member 204 by a negative pressure of the suction pump in suction recovery. In FIG. 20, ink convection currents in this suction recovery are indicated by arrows. Since a connection port 206 (suction port) connecting to the suction pump is much smaller than the internal volume of the cap member 204, all the ink in the cap member 204 is not smoothly drawn to the suction port 206. It is therefore considered that only a part of the ink is drawn to the suction port 206, the rest of the ink not drawn to the suction port 206 stays in the cap member 204 to repeat the ink convection as indicated by the arrows, and the ink is in this manner gradually discharged through the suction port 206. If an ink 205 not removed by the latest suction recovery remains in the cap member 204, the ink convection described above involves this residual ink 205, so an ink mixed with the residual ink 205 is convected in the cap member 204.

When suction recovery is complete and there is no more negative pressure by the suction pump, no suction negative pressure for drawing an ink from the nozzles 203 exists any longer. Consequently, an ink near the nozzles 203 is drawn into the nozzles by a capillary action to form a meniscus. At this time, if an ink mixed with the residual ink 205 is convected in the cap member 204, this ink containing the residual ink 205 is drawn into the nozzles 203.

Due to this phenomenon as described above, in an ink cartridge which performs printing by using a thin ink, the ink density varies under the influence of the residual ink 205 in the cap member 204. Consequently, in the initial stages of a print operation, an ink having an appropriate density is not discharged, and this results in undesirable printing such as variations in the density of printed images. Therefore, when an ink cartridge is to be exchanged for an ink cartridge containing an ink having a different dye concentration, it is necessary to minimize the influence of an ink remaining in the cap member. To this end, especially when exchange for an ink cartridge containing a thin ink is performed, it is necessary to eliminate the residual ink from a cap member to be used in suction and thereby reliably execute suction recovery for the newly attached ink cartridge.

In this embodiment, therefore, when an ink cartridge is exchanged for an ink cartridge containing a thin ink, air-suction for drawing the interior of the cap member by suction is performed before suction recovery. In addition, a larger number of air-suction times is set for an ink having a lower dye concentration. This minimizes the residual ink in the cap member to eliminate the influence of the residual ink in suction recovery after ink cartridge exchange.

In contrast, in suction recovery executed after a new ink cartridge has been attached and the ink of this ink cartridge has been used for printing, the number of suction times is "1" regardless of the density of the ink. That is, the number of air-suction times is changed in accordance with the type of an ink cartridge such that the smaller the dye concentration of ink becomes, the greater the number of air-suction times in ink cartridge exchange becomes only when an ink cartridge is exchanged for an ink cartridge of a different kind. It is unnecessary to increase the number of air-suction times in suction recovery which is intermittently executed while the printer is normally used. Also, when ink cartridges of the same kind are exchanged, inks having the same dye concentration are used. Therefore, it is unnecessary to increase the number of air-suction times even in ink cartridge exchange.

Accordingly, when ink cartridge exchange is performed according to the procedure as shown in FIG. 17 and this exchange is for an ink cartridge of a different kind, the number of air-suction times corresponding to the type of the ink cartridge as shown in FIG. 18 is set.

Consequently, it is possible to set a proper number of air-suction recovery times corresponding to the type of the ink cartridge in ink cartridge exchange. This prevents unnecessary suction recovery from being performed and eliminates wasteful consumption of an ink. Also, the suction recovery operation time is minimized.

(2) Number of Times of Preliminary Discharge after Wiping

A thin ink is more susceptible to the influence of ink having an increased viscosity resulting from wiping. From this point of view, when an ink cartridge containing a thin ink is newly attached, the number of times of preliminary discharge after wiping is increased. This minimizes a density variation of thin ink after wiping.

(3) Preliminary Discharge Intervals during Printing

During a print operation, nozzles which do not discharge an ink are easily dried to cause a density variation. Since a thin ink is more susceptible to the influence of this density variation, shorter intervals of preliminary discharge are set for an ink having a lower dye concentration.

(4) Number of Times of Preliminary Discharge during Printing

As the dye concentration of an ink decreases, the intervals of preliminary discharge during printing are shortened. Therefore, when an ink cartridge containing a thin ink is attached, the number of preliminary discharge times is decreased in accordance with the decrease in the preliminary discharge interval. In this way, total numbers of preliminary discharge times per unit time for different ink cartridges are made almost equal. For example, assuming that the unit time is 60 sec., preliminary discharge is performed 5 times (60/12=5) and a total of 75 (=5×15) times for "ink cartridge 1". For "ink cartridge 2", preliminary discharge is performed about 7 times (60/8=7.5) and a total of 77 times. For "ink cartridge 3", preliminary discharge is performed 10 times (60/6=10) and a total of 80 times. Consequently, the numbers of preliminary discharge times per unit time for these ink cartridges are almost the same.

Figure 19:
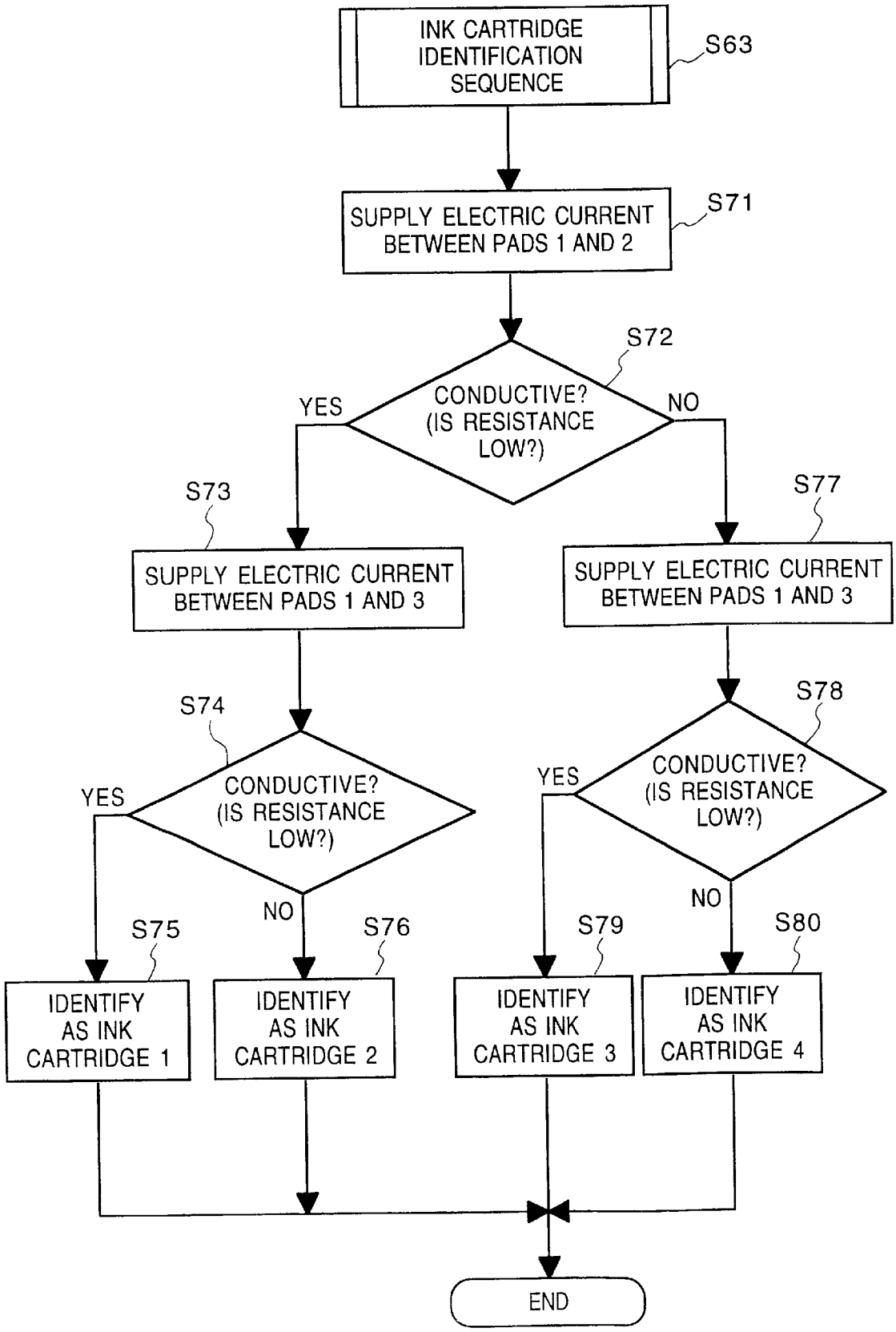
FIG. 19 is a flow chart showing ink cartridge identification processing according to the fourth embodiment of the present invention.

FIG. 19 is a flow chart showing processing of identifying the type of an ink cartridge in this embodiment. The processing is basically identical to the processing shown in the flow chart of FIG. 10; i.e., determination is performed on the basis of the conductive state of the electrode pads 1 to 3 of the contacts 19 shown in FIG. 6. The electrode pad 1 can always be rendered conductive, and the type of an attached ink cartridge is identified on the basis of the states of the electrode pads 2 and 3.

In step S71, a voltage is applied between the electrode pads 1 and 2. In step S72, whether or not a current flows between these electrode pads 1 and 2 applied with the voltage is checked. This is actually done by checking whether the resistance when the voltage is applied is relatively high (insulated state) or relatively low (conductive state). If it is determined that these electrode pads are rendered conductive, the flow advances to step S73, and a voltage is applied between the electrode pads 1 and 3. In step S74, whether or not a current flows between the electrode pads 1 and 3 is checked. If it is determined that the electrode pads 1 and 3 are rendered conductive, the flow advances to step S75. Since all the electrodes are rendered conductive in this case, the attached ink cartridge is identified as "ink cartridge 1". If it is determined in step S74 that the electrode pads 1 and 3 are not rendered conductive, it is determined that only the electrode pad 3 is insulated, and the flow advances to step S76 where the ink cartridge is identified as "ink cartridge 2".

On the other hand, if it is determined in step S72 that the electrode pads 1 and 2 are not rendered conductive, the flow advances to step S77, and a voltage is applied between the electrode pads 1 and 3 as in step S73. In step S78, whether or not the electrode pads 1 and 3 are rendered conductive is checked. If it is determined that the electrode pads 1 and 3 are rendered conductive, the flow advances to step S79, and the ink cartridge is identified as "ink cartridge 3" by determining that only the electrode pad 2 is insulated. If it is determined in step S78 that the electrode pads 1 and 3 are not rendered conductive, the flow advances to step S80. In step S80, it is determined that both the electrode pads 2 and 3 are insulated from the electrode pad 1, and the ink cartridge is identified as "ink cartridge 4". As described above, the type of an ink cartridge currently attached can be identified by checking the conductive states of the electrode pads.

In this embodiment as described above, optimum recovery conditions for an attached integral ink cartridge can be set by identifying the type of the ink cartridge. Consequently, high-quality color images can be formed in accordance with the dye concentration of ink contained in a newly attached ink cartridge without being affected by the density of ink contained in a previously attached ink cartridge, simply by exchanging these ink cartridges.

Note that a user can also specify the type of an ink cartridge by using, e.g., the operation unit.

[Fifth Embodiment]

In the first to fourth embodiments described above, the type of an ink cartridge attached when printing is performed is checked. A driver installed in the host computer (to be referred to as a host hereinafter) 306 automatically sets a print mode corresponding to the type. The host computer 306 performs interlocking control for color processing in this driver and processing in the system controller 301.

In this embodiment, however, in order to reliably select a print mode meeting the intended use of a user, the user can freely set a print mode on the display screen of the host.

Figure 21:
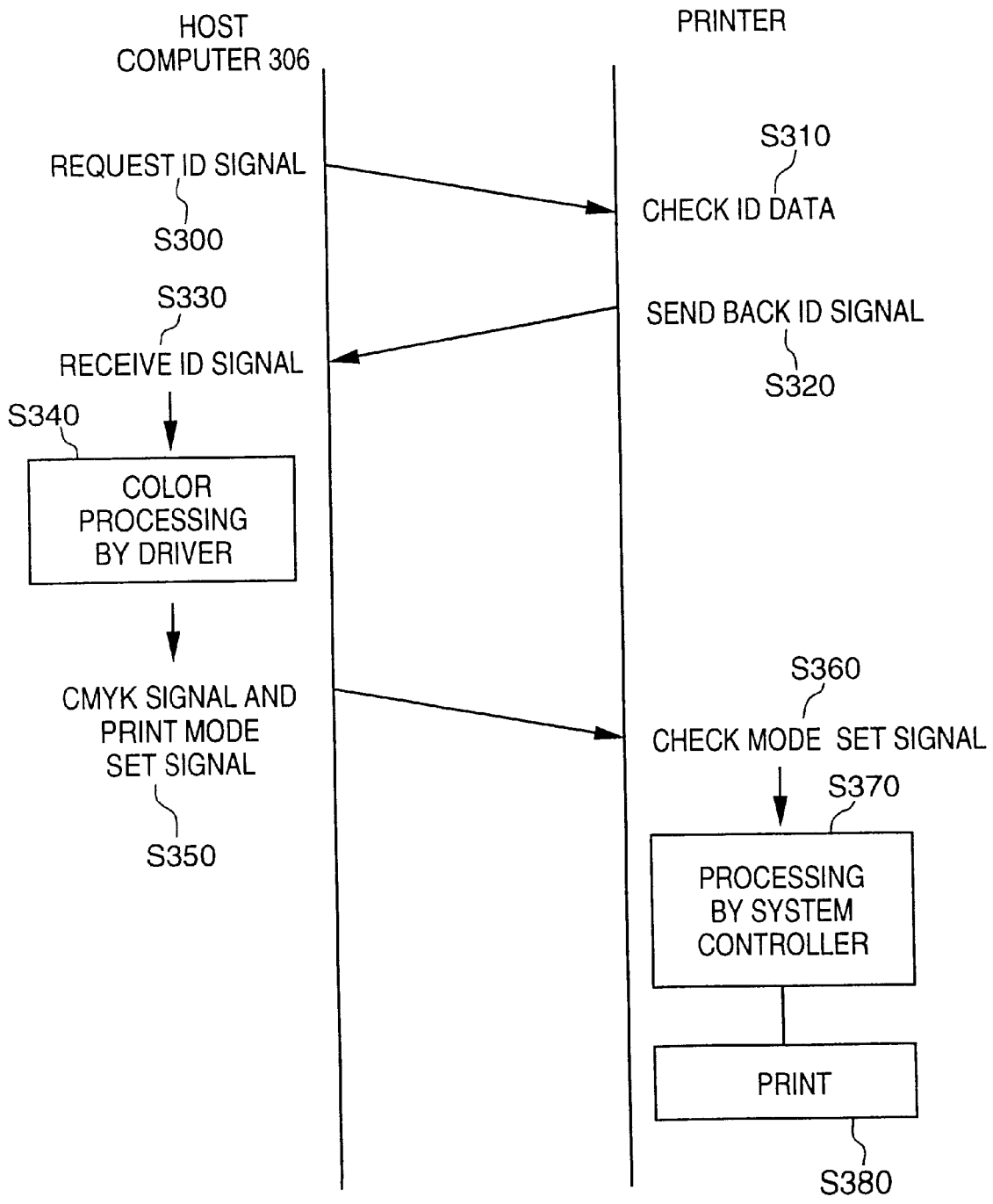
FIG. 21 is a view showing data exchange between a host computer and a printer according to a fifth embodiment of the present invention.

FIG. 21 is a view showing exchange of information between the host and the printer when various print modes are manually set from the host 306.

The operation shown in FIG. 21 will be briefly described below. The host 306 inquires of the printer the type of an attached ink cartridge (S300). The printer reads the ID of the attached ink cartridge, checks the type of the ink cartridge (S310), and sends the ID to the host 306 (S320). The host 306 receives the ID (S330), and performs color processing for image data by using a driver in accordance with the color of an ink contained in the ink cartridge (S340). The host 306 transmits a color signal (CMYK density signal) thus generated and a print mode signal to the printer (S350). The printer receives these signals, performs image bitmapping by using the system controller 301 (S370), and prints the data (S380).

If the host 306 and the printer are connected by an interface such as a Centronics interface and the printer cannot control printing for itself by performing various determinations, the host 306 sets a print mode using a predetermined ink cartridge and instructs the printer to perform print processing corresponding to the set mode. The printer immediately executes the print processing if the conditions of the print mode meet the print mode and the type of an ink cartridge currently attached to the printer. If not, the printer responds to the host by sending an error signal. Accordingly, the host user checks the type of the ink cartridge attached to the printer and again sets a print mode.

Figure 22:
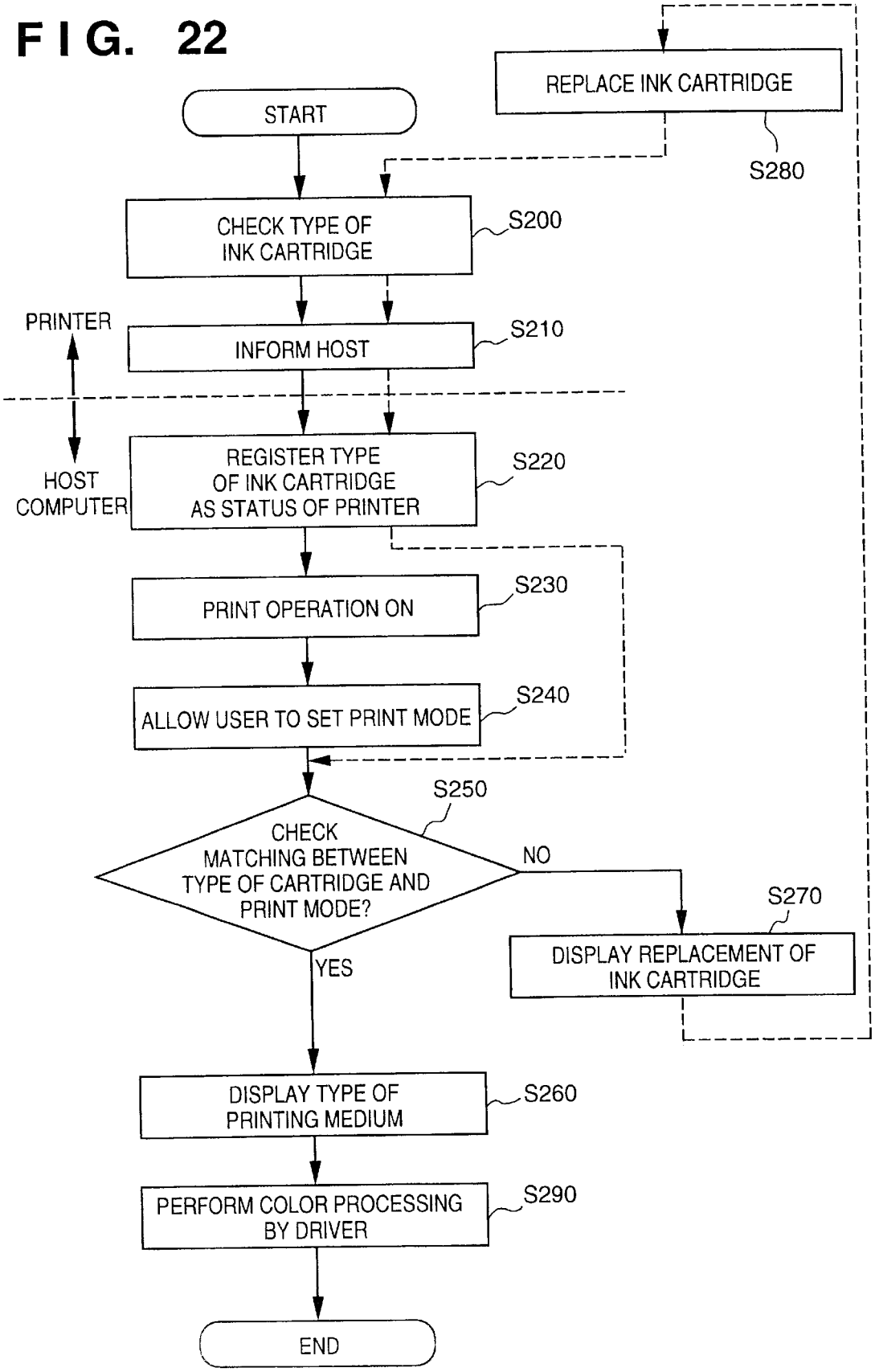
FIG. 22 is a flow chart showing print mode set processing according to the fifth embodiment of the present invention.

FIG. 22 is a flow chart showing print mode set processing in this embodiment.

In step S200, the printer is turned on or an ink cartridge is attached, and the type of the ink cartridge is checked on the basis of the ID of the ink cartridge as in the previous embodiments. In step S210, the host 306 is informed of an ID signal indicating the check result in step S200. These processings in steps S200 and S201 are performed by the printer. The following processings are performed by the host 306.

In step S220, on the basis of the ID signal received from the printer, the host 306 registers the type of the ink cartridge currently attached to the printer, together with the type of the printer, as the status of the printer. In step S230, a print operation is now on. In step S240, on the basis of, e.g., a user interface (UI) as shown in FIG. 23 displayed on the display screen of the host 306, the user manually sets a print mode meeting the intended use of the user.

In this embodiment, each print mode corresponds to a predetermined ID of an ink cartridge. A normal mode is ID1, a pictorial mode 1 is ID2, a pictorial mode 2 is ID3, and a black-and-white mode is ID0.

As explained in the previous embodiments, each ink cartridge corresponds to a predetermined print mode. In step S250, therefore, the host 306 checks whether or not an ink cartridge corresponding to the set print mode is attached by checking the type of the ink cartridge registered in step S220.

If the ink cartridge corresponding to the set print mode is attached, the flow advances to step S260, and the host 306 prompts the user to set a printing medium corresponding to this print mode. In this embodiment, any of plain paper, coated paper, and pictorial paper can be used in the normal mode. Therefore, when the normal mode is set, a message as shown in FIG. 24 is displayed on the display screen of the host.

On the other hand, if the ink cartridge corresponding to the set print mode is not set, the flow advances to step S270, and the host 306 prompts the user to replace the current ink cartridge with the ink cartridge corresponding to the set print mode. For example, if the pictorial mode 1 is set as the print mode although the current ink cartridge is for the normal mode (ID=1), a message as shown in FIG. 25 is displayed on the display screen of the host to prompt the user to switch the ink cartridge to an appropriate type (ink cartridge of ID=2). When the user switches the ink cartridges of the printer in step S280, the processings in steps S200, S210, S220, and S250 described above are executed as indicated by the broken line arrows in FIG. 22, thereby checking again whether or not the ink cartridge corresponding to the set print mode is attached. When the ink cartridge and the printing medium corresponding to the set print mode are thus set, the flow advances to step S290, and the color processing by a driver is started. Thereafter, similar processings as described in the previous embodiments are executed.

In this embodiment as described above, image formation can be reliably performed by a print mode meeting the intended use of a user. This prevents incorrect printing caused by, e.g., a print mode setting error.

When the normal mode or the black-and-white mode is set as the print mode, types of printing media are not limited. Therefore, the process in step S260 can be omitted. Since this decreases the number of times of alarm display, a more user-friendly user interface (UI) can be provided.

In the first to fourth embodiments, the entire suction recovery processing is performed within the printer. However, the suction recovery processing can also be executed by the cooperation of the host and the printer as described in this embodiment. That is, the printer informs the host of attachment/detachment of an ink cartridge, and the host issues a suction recovery instruction to the printer when ink cartridge exchange is performed, thereby executing the suction recovery processing. The host can also specify the number of suction recovery times.

Figure 26:
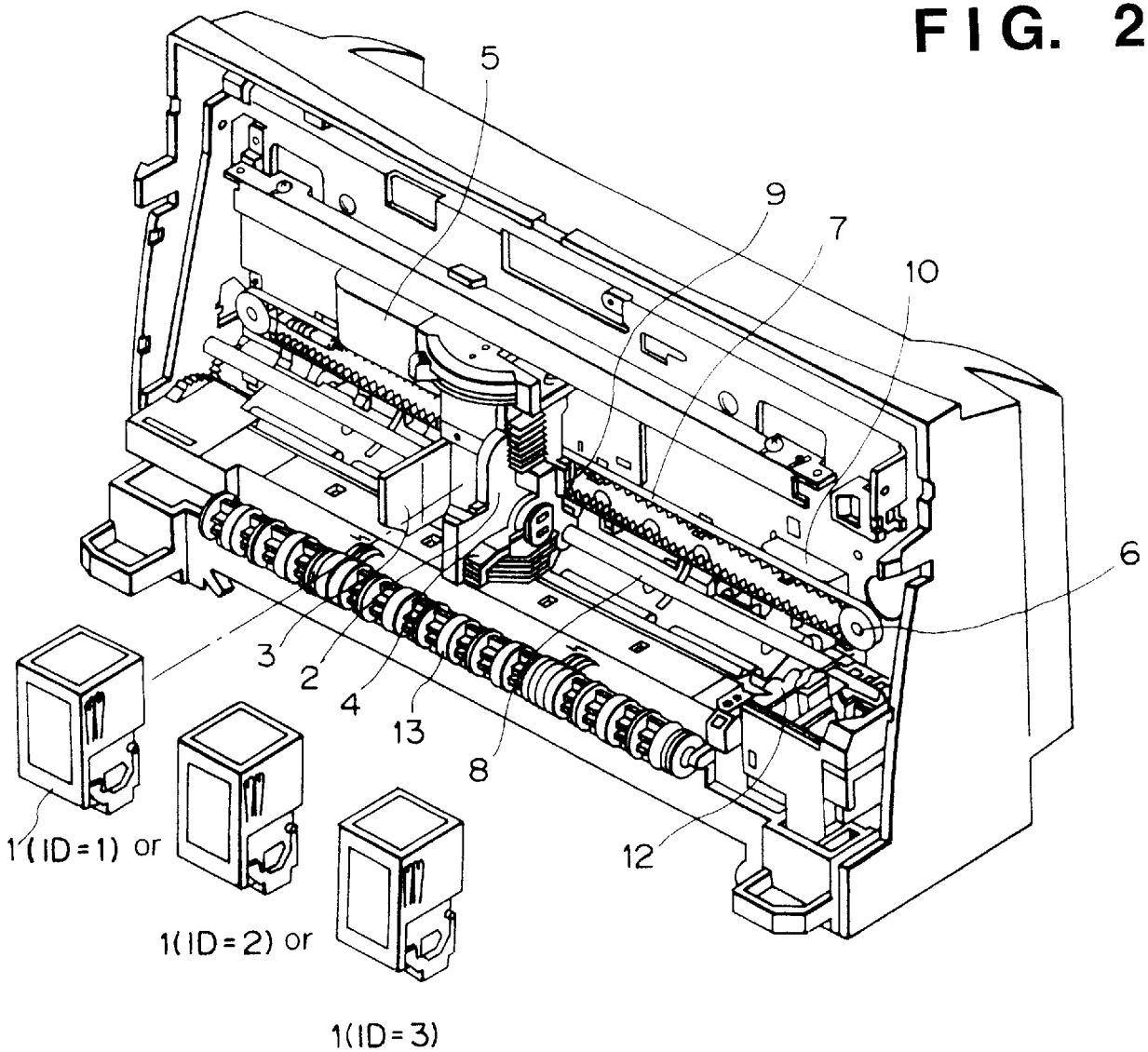
FIG. 26 is a view showing printhead cartridges containing different inks and a printer main body.

FIG. 26 shows ink cartridges corresponding to different print modes and containing inks of different kinds and the inkjet printer shown in FIG. 1.

The three ink cartridges shown in FIG. 26 are given IDs recognizable by the printer. The dye concentrations of yellow, magenta, cyan, and black inks contained in an ink cartridge of ID "1" are 2.5%, 3.0%, 2.7%, and 2.6%, respectively. The dye concentrations of yellow, magenta, cyan, and black inks contained in an ink cartridge of ID "2" are 2.5%, 1.0%, 0.9%, and 1.3%, respectively. The dye concentrations of yellow, magenta, cyan, and black inks contained in an ink cartridge of ID "3" are 2.5%, 0.8%, 0.7%, and 0.9%, respectively.

In this embodiment, each of the yellow, magenta, cyan, and black inks of ID=1 can well express one pixel with gradation of two values. The yellow, magenta, cyan, and black inks of ID=2 can well express one pixel with gradation of two values, four values, four values, and two values, respectively. The yellow, magenta, cyan, and black inks of ID=3 can well express one pixel with gradation of two values, five values, five values, and three values, respectively.

That is, in printing using the inks of ID=1, print data of one pixel is processed by one bit for each of yellow, magenta, cyan, and black. In printing using the inks of ID=2, print data of one pixel is processed by one bit for yellow, two bits for magenta, two bits for cyan, and two bits for black. In printing using the inks of ID=3, print data of one pixel is processed by one bit for yellow, three bits for magenta, three bits for cyan, and two bits for black.

In the printer, the configuration of print buffers is changed in accordance with the IDs of these ink cartridges. That is, when the ink cartridge of ID=1 is attached, 1-pixel 1-bit print buffers are provided for all print data. When the ink cartridge of ID=2 is attached, a 1-pixel 1-bit print buffer is provided for yellow data, and 1-pixel 2-bit buffers are provided for print data of the remaining colors. When the ink cartridge of ID=3 is attached, a 1-pixel 1-bit print buffer is provided for yellow data, 1-pixel 3-bit print buffers are provided for magenta and cyan, and a 1-pixel 2-bit print buffer is provided for black.

When the user selects an ink cartridge in accordance with a print image and a printing medium as described above, the number of gradation levels of the print image can be changed. Even in this case, an increase in capacity of the print buffers can be suppressed by suppressing the gradation of yellow with high luminosity.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

Additionally, the printer according to the present invention can be configured as an integrated or separate image output terminal of an information processor such as a computer and can also be configured as a copying machine combined with a reader or the like.

The concept of color property in the embodiments described above indicates the color intensity of an ink itself or the intensity of color development of an image printed on a printing medium and, in the case of an achromatic color, represents the liminosity of the color. In this sense, the color property indicates the dye concentration of ink when the same dye or pigment is used. In comparison in the form of an image printed on a printing medium, the color property is the optical reflection density or the maximum saturation of almost the same hue. An object having a high degree of so-called color development is regarded as having good color property.

In the embodiments as have been described above, the type of an ink tank used or the type of an ink contained in an ink cartridge is identified to perform optimum recovery control or preliminary discharge control for the ink tank or the ink contained in the ink cartridge. Consequently, optimum print control for the ink can be performed.

Also, in these embodiments, high-quality images can be printed by suppressing a variation of the image density even when a thin ink is used.

Furthermore, in these embodiments, high-quality images can be printed only by exchanging ink tanks or ink cartridges containing inks with different densities.

The present invention can be applied to a system constituted by a plurality of devices, or to an apparatus comprising a single device. Furthermore, it goes without saying that the invention is applicable also to a case where the object of the invention is attained by supplying a program to a system or apparatus. In this case, a storage medium storing the program according to the present invention constitutes the invention. By reading out the program from the storage medium into the system or apparatus, the system or apparatus operates in a predetermined manner.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus in which a printhead for discharging an ink and an ink tank for storing the ink can be separated, and which performs printing by using the printhead to which one of ink tanks respectively containing inks exhibiting different densities is selectively attached, comprising:

identifying means for identifying a type of the attached ink tank;

setting means for setting a magnitude of a recovery operation for the printhead, in accordance with the type of ink tank identified by said identifying means, the recovery operation being executed after the ink tank is attached; and recovery means for executing the recovery operation in accordance with the magnitude set by said setting means, wherein said setting means sets the magnitude in a case where an ink tank containing a thin ink is attached to be larger than that in a case where an ink tank containing a thick ink is attached.

2. The apparatus according to claim 1, wherein said setting means sets the magnitude of a plurality of the recovery operations, wherein the plurality of recovery operations include a recovery operation that is executed at a time just after the ink tank is attached, and a recovery operation that is executed at a time other than just after the ink tank is attached.

3. The apparatus according to claim 2, wherein the magnitude of the recovery operation executed at the time other than just after the ink tank is attached is not changed by the type of the ink tank.

4. The apparatus according to claim 1, wherein the type of the ink tank is determined in accordance with a density of the ink contained in the ink tank.

5. The apparatus according to claim 4, wherein said setting means sets the magnitude of the recovery operation when the ink tank containing ink with a high density is attached to be lower than that when the ink tank containing ink with a low density is attached.

6. The apparatus according to claim 1, wherein said setting means changes the magnitude of the recovery operation when the type of a newly attached ink tank is different from that of a previously attached ink tank, while said setting means does not change the magnitude of the recovery operation when the type of the newly attached ink tank is the same as that of the previously attached ink tank.

7. The apparatus according to claim 1, further comprising designating means for manually designating the type of ink tank to be attached.

8. The apparatus according to claim 7, further comprising detecting means for detecting whether the ink tank is attached or detached, wherein when said detecting means detects that the ink tank is detached, said recovery means removes ink remaining in the printhead by suction in accordance with the type of the ink tank designated by said designating means before the ink tank is attached.

9. The apparatus according to claim 8, wherein the suction removal is performed when the type of new ink tank to be attached is different from that of the detached ink tank, and is not performed when the type of new ink tank to be attached is the same as that of the detached ink tank.

10. The apparatus according to claim 1, wherein the printhead comprises a plurality of ink tanks, and the ink tanks include a first ink tank containing black ink and a second ink tank having a plurality of compartments containing yellow, cyan, and magenta inks.

11. The apparatus according to claim 10, wherein the first ink tank contains a thin or thick ink in accordance with a concentration of a dye constituting the black ink.

12. The apparatus according to claim 10, wherein the second ink tank contains thin or thick inks in accordance with concentrations of dyes constituting the yellow, cyan, and magenta inks.

13. The apparatus according to claim 1, further comprising:

input means for inputting a recovery operation execution instruction from a host computer; and remote recovery control means for controlling said recovery means to execute the recovery operation in accordance with the magnitude designated by the recovery operation execution instruction input by said input means.

14. The apparatus according to claim 1, wherein the printhead comprises an electrothermal transducer for generating thermal energy used to cause film boiling in the ink to discharge the ink.

15. The apparatus according to claim 1, wherein the tank has information indicating the type of the ink tank.

16. The apparatus according to claim 15, wherein the information is expressed by a combination of two states, an insulated state and a conductive state, of each of a plurality of electrode pads.

17. An inkjet printing apparatus for performing printing by using a printhead for discharging an ink, the printhead having a plurality of printing elements divided into a plurality of blocks, said apparatus comprising:

driving means for driving the plurality of printing elements in units of the blocks;

measuring means for measuring a time elapsed from an immediately previous ink discharge for each of the blocks;

determining means for determining whether a predetermined time of each block measured by said measuring means has elapsed; and preliminary discharge control means for controlling a drive of the printhead to perform preliminary ink discharge of a block for which has been determined by said determining means that the predetermined time has elapsed.

18. The apparatus according to claim 17, further comprising a table for storing the elapsed time of each block, and wherein said preliminary discharge control means resets an elapsed time stored in said table to correspond to a block for which the preliminary discharge has been performed.

19. The apparatus according to claim 17, further comprising detecting means for detecting whether or not an ink tank for supplying an ink to the printhead is attached; and identifying means for identifying a type of the attached ink tank detected by said detecting means, wherein said preliminary discharge control means performs the control in accordance with the type of ink tank identified by said identifying means.

20. The apparatus according to claim 19, wherein the ink tank contains a thin or thick ink in accordance with a concentration of a dye constituting the ink.

21. The apparatus according to claim 20, wherein the type of ink tank is determined in accordance with a density of ink contained in the ink tank, and said preliminary discharge control means performs the control when the ink tank contains a thin ink.

22. The apparatus according to claim 19, wherein the ink tank comprises a first ink tank containing black ink and a second ink tank having a plurality of compartments containing yellow, cyan, and magenta inks.

23. The apparatus according to claim 22, wherein the first ink tank contains a thin or thick ink in accordance with a concentration of a dye constituting the black ink.

24. The apparatus according to claim 22, wherein the second ink tank contains thin or thick inks in accordance with concentrations of dyes constituting the yellow, cyan, and magenta inks.

25. The apparatus according to claim 17, wherein the printhead comprises an electrothermal transducer for generating thermal energy used to cause film boiling in an ink to discharge the ink.

26. The apparatus according to claim 19, wherein the ink tank has information indicating the type of the ink tank.

27. The apparatus according to claim 26, wherein the information is expressed by a combination of two states, an insulated state and a conductive state, of each of a plurality of electrode pads.

28. An inkjet printing apparatus for performing printing by using an ink cartridge in which a printhead for discharging an ink and an ink tank for storing the ink are integrally formed, comprising:

attaching means to which either a first ink cartridge having an ink tank containing a thick ink or a second ink cartridge having an ink tank containing a thin ink is selectively attached;

capping means for capping an ink discharge surface of the printhead that is integrally formed in the first or second ink cartridge attached to said attaching means;

identifying means for identifying whether the ink cartridge attached to said attaching means is the first ink cartridge or the second ink cartridge;

setting means for setting a magnitude of a recovery operation, which includes a first suction operation for drawing ink from an interior of said capping means by suction and a second suction operation for drawing ink from discharge nozzles of the printhead by suction, in accordance with an identification result by said identifying means; and recovery means for executing the recovery operation in accordance with the magnitude set by said setting means, wherein said setting means sets the magnitude in a case where the second ink cartridge is attached to be larger than that in a case where the first ink cartridge is attached.

29. The apparatus according to claim 28, wherein said setting means sets the magnitude of a plurality of recovery operations, wherein the plurality of recovery operations include a recovery operation that is executed at a time just after the ink cartridge is attached, and a recovery operation that is executed at a time other than just after the ink cartridge is attached.

30. The apparatus according to claim 29, wherein the number of times of the recovery operation to be executed at the time other than just after the ink cartridge is attached is not changed by the identification result.

31. The apparatus according to claim 28, wherein said setting means sets the magnitude of the first suction operation in accordance with the identification result.

32. The apparatus according to claim 28, wherein the cartridge is identified in accordance with a density of the ink contained in the ink tank.

33. The apparatus according to claim 32, wherein said setting means decreases the magnitude of the first suction operation when the ink cartridge including an ink tank containing ink with a high density is attached, while said setting means increases the magnitude of the first suction operation when the ink cartridge including an ink tank containing ink with a low density is attached.

34. The apparatus according to claim 28, wherein said setting means changes the magnitude of the first suction operation when a newly attached ink cartridge is different from that of a previously attached ink cartridge, while said setting means does not change the magnitude of the first suction operation when the newly attached ink cartridge matches that of the previously attached ink cartridge.

35. The apparatus according to claim 28, wherein each of the ink tanks in the first and second ink cartridges comprises a first compartment containing black ink, a second compartment containing yellow ink, a third compartment containing cyan ink, and a fourth compartment containing magenta ink.

36. The apparatus according to claim 35, wherein the first, second, third, and fourth compartments in the ink tank of the first ink cartridge contain thick inks in accordance with concentrations of dyes constituting the black, yellow, cyan, and magenta inks, respectively, and the first, second, third, and fourth compartments in the ink tank of the second ink cartridge contain thin inks in accordance with concentrations of dyes constituting the black, yellow, cyan, and magenta inks.

37. The apparatus according to claim 28, further comprising:

input means for inputting a recovery operation execution instruction from a host computer; and remote recovery control means for controlling said recovery means to execute the recovery operation in accordance with a magnitude the recovery operation execution instruction input by said input means.

38. The apparatus according to claim 28, wherein the printhead comprises an electrothermal transducer for generating thermal energy used to cause film boiling in the ink to discharge the ink.

39. The apparatus according to claim 28, wherein the ink cartridge has information indicating the type of the ink cartridge.

40. The apparatus according to claim 39, wherein the information is expressed by a combination of two states, an insulated state and a conductive state, of each of a plurality of electrode pads.

41. A print control method of printing by using a printhead, to which one of ink tanks respectively containing inks exhibiting different densities is selectively attached, for discharging an ink, said method comprising:

an identification step of identifying a type of the attached ink tank;

a setting step of setting a magnitude of a recovery operation for the printhead in accordance with the type of ink tank identified in said identification step, the recovery operation being executed after the ink tank is attached, and a recovery step of executing the recovery operation in accordance with the magnitude set in said setting step, wherein said setting step sets the magnitude in a case where the ink tank containing a thin ink is attached to be larger than that in a case where the ink tank containing a thick ink is attached.

42. The method according to claim 41, wherein the type of the attached ink tank is determined in accordance with a density of ink contained in the ink tank, and the magnitude of the recovery operation is decreased when the ink tank containing ink with a high density is attached, while the magnitude of the recovery operation is increased when the ink tank containing ink with a low density is attached, in said setting step.

43. The method according to claim 41, wherein the magnitude of the recovery operation is changed when the type of a newly attached ink tank is different from that a previously attached ink tank, while the magnitude of the recovery operation is not changed when the type of the newly attached ink tank is the same as that of the previously attached ink tank, in said setting step.

44. A print control method of performing printing by using a printhead for discharging an ink, the printhead having a plurality of printing elements divided into a plurality of blocks, said method comprising:

a driving step of driving the plurality of printing elements in units of the blocks;

a measurement step of measuring a time elapsed from an immediately previous ink discharge for each of the blocks;

a determination step of determining whether a predetermined time of each block measured in said measurement step has elapsed; and a preliminary discharge control step of controlling a drive of the printhead to perform preliminary ink discharge for a block for which has been determined at said determination step that the predetermined time has elapsed.

45. The method according to claim 44, further comprising an identification step of identifying a type of an ink tank in accordance with a density of ink contained in the ink tank, wherein the control is performed in said preliminary discharge control step when the ink tank contains a thin ink.

46. A print control method applied to a printing apparatus comprising attaching means to which either a first ink cartridge having an ink tank containing a thick ink and a printhead for discharging the ink or a second ink cartridge having an ink tank containing a thin ink and a printhead for discharging the ink is selectively attached, and a cap for capping an ink discharge surface of the printhead of the first or second ink cartridge attached to said attaching means, said method comprising:

an identification step of identifying whether an ink cartridge attached to the attaching means is the first ink cartridge or the second ink cartridge;

a setting step of setting a magnitude of a recovery operation, which includes a first suction operation for drawing ink from an interior of the cap by suction and a second suction operation for drawing ink from discharge nozzles of the printhead by suction, in accordance with an identification result in said identification step; and a recovery step of executing the recovery operation in accordance with the magnitude set in said setting step, wherein said setting means sets the magnitude in a case where the second ink cartridge is attached to be larger than that in a case where the first ink cartridge is attached.

47. The method according to claim 46, wherein, in said setting step, the magnitude of the first suction operation is set in accordance with the identification result in said identification step.

48. The method according to claim 46, wherein the cartridge is identified in accordance with a density of the ink contained in the ink tank, and the magnitude of the first suction operation is decreased when the ink cartridge including an ink tank containing ink with a high density is attached, while the magnitude of the first suction operation is increased when the ink cartridge including an ink tank containing ink with a low density is attached, in said setting step.

49. The method according to claim 46, wherein, in said setting step, the magnitude of the first suction operation is changed when a newly attached ink cartridge is different from that of a previously attached ink cartridge, while the magnitude of the first suction operation is not changed when the newly attached ink cartridge is the same as that of the previously attached ink cartridge.

50. An inkjet printing apparatus for performing printing by using a printhead for discharging an ink, comprising:

attaching means to which either a first printhead for discharging a thick ink or a second printhead for discharging an thin ink is selectively attached;

capping means for capping an ink discharge surface of the first or second printhead attached to said attaching means;

identifying means for identifying whether the printhead attached to said attaching means is the first printhead or the second printhead;

recovery means for executing a suction recovery operation, including a suction process for drawing residual ink from an interior of said capping means, for the first or second printhead attached to said attaching means through said capping means; and control means for controlling said recovery means such that a suction amount in the suction process in a case where said identification means identifies that the second printhead is attached to said attaching means is greater than the suction amount in a case where said identification means identifies that the first printhead is attached to said attaching means.

51. The apparatus according to claim 50, further comprising an ink tank containing the thick ink or the thin ink.

52. The apparatus according to claim 51, wherein the ink tank comprises a first compartment containing a black ink, a second compartment containing a yellow ink, a third compartment containing a cyan ink, and a fourth compartment containing a magenta ink.

53. The apparatus according to claim 52, wherein, if the first printhead is attached, the first, second, third, and fourth compartments in the ink tank contain thick inks in accordance with concentrations of dyes constituting the black, yellow, cyan, and magenta inks, respectively, and wherein if the second printhead is attached, the first, second, third, and fourth compartments in the ink tank contain thin inks in accordance with concentrations of dyes constituting the black, yellow, cyan, and magenta inks.

54. The apparatus according to claim 50, further comprising:

input means for inputting a recovery operation execution instruction from a host computer; and remote recovery control means for controlling said recovery means to execute the recovery operation in accordance with a magnitude designated by the recovery operation execution instruction input by said input means.

55. The apparatus according to claim 50, wherein each of the first and second printheads comprises an electrothermal transducer for generating thermal energy used to cause film boiling in the ink to discharge the ink.

56. The apparatus according to claim 50, wherein each of the first and second printheads has information indicating a type of the printhead.

57. The apparatus according to claim 56, wherein the information is expressed by a combination of two states, an insulated state and a conductive state, of each of a plurality of electrode pads.

58. A print control method applied to an inkjet printing apparatus which performs printing by selectively attaching either a first printhead for discharging a thick ink or a second printhead for discharging a thin ink, the apparatus having capping means for capping an ink discharge surface of the attached first or second printhead, said method comprising:

an identifying step of identifying whether the printhead attached to the attaching means is the first printhead or the second printhead;

a recovery step of executing a suction recovery operation, including a suction process for drawing residual ink from an interior of the capping means, for the attached first or second printhead through the capping means; and a control step of controlling the suction recovery operation such that a suction amount in the suction process in a case where said identification step identifies that the second printhead is attached is greater than the suction amount in case where said identification step identifies that the first printhead is attached.

* * * * *

UNITED STATES PATENT AND TRADEMARK OFFICE

CERTIFICATE OF CORRECTION

PATENT NO. : 6,142,600
DATED : November 7, 2000
INVENTOR(S) : Takahashi et al.

It is certified that error appears in the above-identified patent and that said Letters Patent is hereby corrected as shown below:

Title page,
Item [56] References Cited,
U.S. PATENT DOCUMENTS, the following should be inserted:

| | | |
|---|---|---|
| -- 4,872,027 | 10/1989 | Buskirk et al. ..... 347/19 |
| 5,714,990 | 2/1998 | Courtney ..... 347/14 |
| 5,739,828 | 4/1998 | Moriyama et al. ..... 347/9 --. |

FOREIGN PATENT DOCUMENTS, "7052390" should read -- 7-52390 --, and "7144419" should read -- 7-144419 --.

Column 25,
Line 8, "prising" should read -- prising: --.

Column 26,
Line 55, "the" should read -- of the --.

Column 27,
Line 31, "that a" should read -- that of a --.

Column 28,
Line 41, "an" should read -- a --.

Signed and Sealed this

Second Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,142,600
DATED : November 7, 2000
INVENTOR(S) : Takahashi et al.

It is certified that error appears in the above-identified patent and that said Letters Patent is hereby corrected as shown below:

Title page,
Item [56], References Cited, U.S. PATENT DOCUMENTS, the following should be inserted:

| | | |
|---|---|---|
| -- 4,872,027 | 10/1989 | Buskirk et al. ……...347/19 |
| 5,714,990 | 2/1998 | Courtney ……..347/14 |
| 5,739,828 | 4/1998 | Moriyama et al. …...347/9 --. |

FOREIGN PATENT DOCUMENTS, "7052390" should read -- 7-52390 --, and "7144419" should read -- 7-144419 --.

Column 25,
Line 8, "prising" should read -- prising: --.

Column 26,
Line 55, "the" should read -- of the --.

Column 27,
Line 31, "that a" should read -- that of a --.

Column 28,
Line 41, "an" should read -- a --.

Signed and Sealed this

Nineteenth Day of October, 2004

JON W. DUDAS
*Director of the United States Patent and Trademark Office*